US011247859B2

(12) United States Patent
Deno

(10) Patent No.: US 11,247,859 B2
(45) Date of Patent: Feb. 15, 2022

(54) IMAGE FORMING APPARATUS HAVING CONTROLLED SHEET FEEDING

(71) Applicant: CANON KABUSHIKI KAISHA, Tokyo (JP)

(72) Inventor: Kohei Deno, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 28 days.

(21) Appl. No.: 16/434,233

(22) Filed: Jun. 7, 2019

(65) Prior Publication Data

US 2020/0002112 A1 Jan. 2, 2020

(30) Foreign Application Priority Data

Jun. 27, 2018 (JP) ..... JP2018-122284
Apr. 26, 2019 (JP) ..... JP2019-086469

(51) Int. Cl.
*B65H 5/06* (2006.01)
*G03G 15/23* (2006.01)
*G03G 15/00* (2006.01)

(52) U.S. Cl.
CPC ..... *B65H 5/062* (2013.01); *G03G 15/234* (2013.01); *G03G 15/6561* (2013.01);
(Continued)

(58) Field of Classification Search
CPC ..... G03G 15/234; G03G 15/6579; G03G 2215/00559; G03G 2215/00586;
(Continued)

(56) References Cited

U.S. PATENT DOCUMENTS 7,268,912 B2 * 9/2007 Murata ..... G06K 15/02 358/1.16
10,197,961 B2 2/2019 Deno
(Continued)

FOREIGN PATENT DOCUMENTS

EP 3 330 803 A2 6/2018
JP 2002-365862 A 12/2002
(Continued)

OTHER PUBLICATIONS

European Search Report dated Nov. 29, 2019, in related European Patent Application No. 19179601.0.

*Primary Examiner* — Justin N Olamit
(74) *Attorney, Agent, or Firm* — Venable LLP

(57) ABSTRACT

An image forming apparatus is configured such that in a case where images are to be formed on a first surface of a preceding sheet, on a first surface of a succeeding sheet fed to the first conveyance path succeeding to the preceding sheet and on a second surface of the preceding sheet, a first conveyance member is stopped without reversing the preceding sheet to a second conveyance path in a case where the image has been formed on the first surface of the preceding sheet and permission of preparing the image to be formed on the first surface of the succeeding sheet is not issued yet. The first conveyance member restarts conveyance of the preceding sheet to the second conveyance path based on timing when an image forming unit starts preparing the image to be formed on the first surface of the succeeding sheet.

13 Claims, 15 Drawing Sheets

(52) U.S. Cl.
CPC ... *G03G 15/6579* (2013.01); *B65H 2403/732* (2013.01); *G03G 2215/00586* (2013.01); *G03G 2215/00679* (2013.01)

(58) Field of Classification Search
CPC ..... G03G 15/6561; G03G 2215/00679; B65H 5/062; B65H 2403/732
See application file for complete search history.

(56) References Cited

U.S. PATENT DOCUMENTS

| | | | | |
|---|---|---|---|---|
| 10,579,001 | B2 * | 3/2020 | Endoh ..... | G03G 15/6579 |
| 2003/0190179 | A1 | 10/2003 | Kinoshita et al. | |
| 2015/0363677 | A1 | 12/2015 | Nihei | |
| 2017/0235254 | A1 | 8/2017 | Deno | |
| 2017/0235269 | A1 | 8/2017 | Deno | |
| 2019/0072893 | A1 | 3/2019 | Deno | |
| 2019/0121274 | A1 | 4/2019 | Deno | |

FOREIGN PATENT DOCUMENTS

| | | | |
|---|---|---|---|
| JP | 2013-010601 | A | 1/2013 |
| JP | 2013-230889 | A | 11/2013 |
| JP | 2017-019651 | A | 1/2017 |

* cited by examiner

IMAGE FORMING APPARATUS HAVING CONTROLLED SHEET FEEDING

BACKGROUND OF THE INVENTION

Field of the Invention

The present invention relates to an image forming apparatus configured to form an image on a sheet.

Description of the Related Art

An image forming apparatus such as a printer, a copier and a multi-function printer widely adopts a configuration of forming images on both sides of a sheet. Typically, a configuration of forming an image on one side of a sheet by an image forming unit and of then forming another image on the other side of the sheet by conveying the sheet to the image forming unit again by switching back the sheet by a reverse conveyance roller pair that rotates normally and reversely is known.

Japanese Patent Application Laid-open No. 2013-010601 discloses a configuration of conveying three sheets simultaneously in a sheet re-feeding path from the reverse conveyance roller pair to a registration roller pair via a plurality of re-feeding roller pairs. In this configuration, the reverse conveyance roller pair, an upstream re-feeding roller pair and a downstream re-feeding roller pair are driven respectively by different motors, and driving speeds of these motors are independently controlled. Japanese Patent Application Laid-open No. 2002-365862 discloses a configuration making a plurality of sheets to wait such that distances between the sheets are shortened as much as possible corresponding to a length of a sheet circulating path of an image forming unit and a duplex conveyance portion, in order to suppress a drop of productivity.

By the way, it is sometimes necessary to cause the sheets to wait before an image forming operation because the image forming operation cannot be started at desirable timing in a case where it takes a time in developing large-volume image data for example. Here, in a case where a succeeding sheet is made to wait without being able to start an image forming process on a first sheet of the succeeding sheet after forming an image on a first surface of a preceding sheet, the preceding sheet is made to wait on a path (i.e., a re-conveyance path) for reversing and conveying the sheet again to the image forming unit.

In such a case, according to the configurations described in the abovementioned respective documents, the preceding sheet is made to wait after being conveyed downstream of the re-conveyance path as much as possible under a condition that it does not collide with a sheet already existing on the re-conveyance path. However, the inventor has found that there may be a case of causing a trouble by conveying the preceding sheet downstream of the re-conveyance path as much as possible as described above.

SUMMARY OF THE INVENTION

The present invention provides an image forming apparatus capable of appropriately controlling sheet positions in forming images on both surfaces of the sheets.

According to one aspect of the invention, an image forming apparatus includes: a first conveyance path; an image forming unit configured to form an image on a sheet passing through the first conveyance path; a first conveyance member configured to receive the sheet from the first conveyance path and convey the sheet to reverse the sheet; a second conveyance path through which the sheet reversed by the first conveyance member is guided to the first conveyance path; a first driving source configured to drive the first conveyance member; and a controller configured to control the first driving source such that in a case where images are to be formed on a first surface of a preceding sheet, on a first surface of a succeeding sheet fed to the first conveyance path succeeding to the preceding sheet and on a second surface of the preceding sheet, the controller causes the first conveyance member to stop without reversing the preceding sheet in a direction of heading to the second conveyance path in a case where the image has been formed on the first surface of the preceding sheet and permission of preparing the image to be formed on the first surface of the succeeding sheet is not issued yet, and the controller causes the first conveyance member to restart conveyance of the preceding sheet to the second conveyance path based on timing when the image forming unit starts preparing the image to be formed on the first surface of the succeeding sheet.

According to another aspect of the invention, an image forming apparatus includes: a first conveyance path; an image forming unit configured to form an image on a sheet passing through the first conveyance path; a first conveyance member configured to receive the sheet from the first conveyance path and convey the sheet to reverse the sheet; a second conveyance path through which the sheet reversed by the first conveyance member is guided to the first conveyance path; a third conveyance member disposed on the second conveyance path and configured to convey the sheet reversed by the first conveyance member toward the first conveyance path; a first driving source configured to drive the first conveyance member; a second driving source configured to drive the third conveyance member; and a controller configured to control the first driving source and the second driving source such that in a case where images are to be formed on a first surface of a preceding sheet, on a first surface of a succeeding sheet fed to the first conveyance path succeeding to the preceding sheet and on a second surface of the preceding sheet, the controller stops the first driving source to stop conveyance of the preceding sheet in a state before a leading edge, in a sheet conveyance direction of the second conveyance path, of the preceding sheet reaches the third conveyance member in a case where the image has been formed on the first surface of the preceding sheet and permission of preparing the image to be formed on the first surface of the succeeding sheet is not issued yet, and the controller restarts drive of the first driving source to pass the preceding sheet to the third conveyance member based on timing when the image forming unit starts preparing the image to be formed on the first surface of the succeeding sheet.

Further features of the present invention will become apparent from the following description of exemplary embodiments with reference to the attached drawings.

DESCRIPTION OF THE EMBODIMENTS

Figure 1:
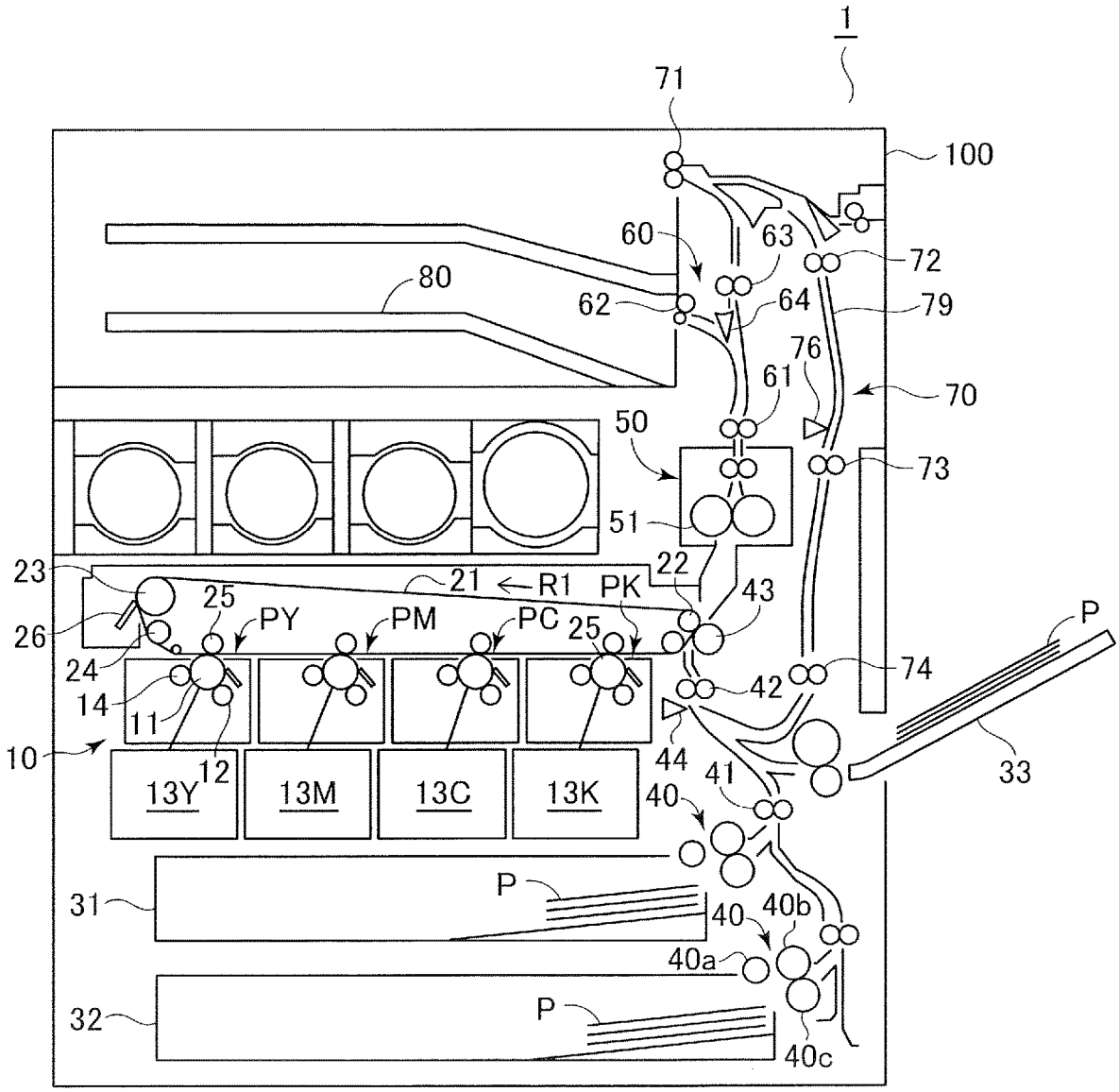
FIG. 1 is a schematic diagram illustrating a configuration of an image forming apparatus of a first embodiment.

An image forming apparatus of the present disclosure will be described below with reference to the drawings. The image forming apparatus may be a printer, a copier, a facsimile machine or a multi-function printer, and is configured to form an image on a sheet used as a recording medium based on image information inputted from an external personal computer or read from a document.

First Embodiment

The image forming apparatus 1 of the present embodiment is an electrophotographic full-color laser printer forming an image on a sheet P used as the recording medium. As for the sheet P, a plain paper, a paper envelope, a coated sheet, plastic film such as an overhead projector sheet and a cloth may be used. An apparatus body 100 of the image forming apparatus 1 is provided with an image forming engine 10 including four image forming units PY, PM, PC and PK respectively forming toner images of yellow, magenta, cyan and black and an intermediate transfer belt 21. Each of the image forming units PY through PK includes a photosensitive drum 11 serving as an image bearing member on which the toner image is formed. The toner images borne on the photosensitive drums 11 are transferred onto the sheet P through the intermediate transfer belt 21 serving as an intermediate transfer body.

Because the image forming units PY through PK are constructed in the same manner except of that colors of toners to be developed are different, the configuration of the image forming units and a toner image forming process, i.e., an image forming operation, will be described below by exemplifying the yellow image forming unit PY. Beside the photosensitive drum 11, the image forming unit PY includes a charging roller 12 serving as a charging member, an exposure unit 13Y serving as an exposing device, a developing unit 14 serving as a developing device, and a drum cleaner. The photosensitive drum 11 is a drum-like photosensitive member having a photosensitive layer around an outer-circumference thereof and rotates in a direction along a rotational direction R1 of the intermediate transfer belt 21. The charging roller 12 homogeneously charges a surface of the photosensitive drum 11, and the exposure unit 13Y irradiates the surface of the photosensitive drum 11 with a laser beam modulated corresponding to image information. Thus, an image writing operation of writing an electrostatic latent image on the surface of the photosensitive drum 11 is executed. The developing unit 14 stores developer containing the toner and develops the electrostatic latent image as a toner image by supplying the toner to the photosensitive drum 11. The toner image formed on the photosensitive drum 11 is primarily transferred onto the intermediate transfer belt 21 by a primary transfer roller 25 serving as a primary transfer device. Residual toner left on the photosensitive drum 11 after the transfer is removed by the drum cleaner.

The intermediate transfer belt 21 is wrapped around a secondary transfer inner roller 22, a stretch roller 23, a tension roller 24 and the primary transfer rollers 25 and is driven to rotate in a counterclockwise direction (see arrow R1) in FIG. 1. The image forming operations described above are executed in parallel in the respective image forming units PY through PK, and the four color toner images are superimposed so as to overlap with each other to form a full-color toner image on the intermediate transfer belt 21. This toner image is borne on the intermediate transfer belt 21 and is conveyed to a transfer portion, i.e., a secondary transfer portion, provided as a nip portion between the secondary transfer inner roller 22 and a secondary transfer roller 43. The secondary transfer roller 43 serving as a transfer member is applied with a bias voltage having an inverse polarity from the charging polarity of the toner to secondarily transfer the toner image borne on the intermediate transfer belt 21 onto the sheet P. Residual toner left on the intermediate transfer belt 21 after the transfer is removed by a belt cleaner 26.

The sheet P onto which the toner image has been transferred is passed to a fixing unit 50. The fixing unit 50 includes a fixing roller pair 51 nipping and conveying the sheet P and including a heat source such as a halogen heater to apply pressure and heat to the toner image borne on the sheet P. Thereby, toner particles melt and adhere to the sheet P, enabling to obtain a fixed image fixed onto the sheet P.

Next, a sheet conveyance operation of the image forming apparatus 1 will be described. The sheet P is stored in a sheet feed cassette 31 or 32, which are drawably mounted in the apparatus body 100, each serving as a sheet storage portion. The sheet P stored in the sheet feed cassette 31 or 32 is fed one by one by a feed unit 40. The feed unit 40 includes a pickup roller 40*a* delivering the sheet P out of the sheet feed cassette 31 or 32 and a feed roller 40*b* conveying the sheet P received from the pickup roller 40*a*. The feed unit 40 also includes a separation roller 40*c* separating the sheet P conveyed by the feed roller 40*b* from another sheet P. It is noted that the feed unit 40 described above is one example of a sheet feed unit for feeding the sheet P, and another type sheet feed unit such as a belt-type sheet feeding unit conveying the sheet P by adsorbing to a belt member by a suction fan and a friction separation-type sheet feed unit using a pad may be also used. A user can also set the sheet P directly on a manual feed tray 33 provided on a side of the apparatus body 100, and the sheet P set on the manual feed tray 33 is also fed by the sheet feed unit.

The sheet P delivered out of the feed unit 40 is conveyed to a registration roller pair 42 through a pre-registration roller pair 41. The registration roller pair 42, which is one example of a registration member, corrects a skew of the sheet P by abutting with a leading edge of the sheet P, i.e., a downstream end in a sheet conveyance direction of the sheet P. After that, the registration roller pair 42 sends the sheet P to the secondary transfer portion with timing adjusted with advance of the image forming operation of the image forming units PY through PK. The sheet P onto which the toner image has been transferred at the secondary transfer portion and the image has been fixed by the fixing unit 50 is passed to a sheet discharge portion 60 wherein the sheet P is conveyed by a post-fixing roller pair 61 toward a change-over member 64 capable of switching a conveyance path of the sheet P.

In a case where the formation of the image onto the sheet P has been completed, the sheet P on which the image has been formed on a first side, i.e., a front side, thereof is discharged onto a discharge tray 80 by the discharge roller pair 62. In a case where an image is to be formed on a second side, i.e., a back side, of the sheet P, the sheet P is passed by the change-over member 64 to a reverse conveyance portion 70 through a conveyance roller pair 63. The reverse conveyance portion 70 includes a reverse conveyance roller pair 71 reversing and conveying, i.e., switching back, the sheet P, and a duplex conveyance path 79 guiding the sheet P switched back by the reverse conveyance roller pair 71 toward the registration roller pair 42. The reverse conveyance roller pair 71 sends the sheet P to the duplex conveyance path 79 by conveying the sheet P in a backward direction after conveying the sheet P toward a discharge space above the discharge tray 80 by a predetermined distance. The duplex conveyance path 79 is provided with a plurality of conveyance roller pairs 72, 73 and 74 as described later in detail to convey the sheet P toward the registration roller pair 42 again. Then, the sheet P onto which the image has been formed on the second side thereof by passing through the second transfer portion and the fixing unit 50 is discharged by the discharge roller pair 62 onto the discharge tray 80.

It is noted that the image forming engine 10 described above is merely one example of the image forming unit and may be also a direct transfer-type engine that directly transfers the toner image formed on the photosensitive member onto a sheet at a transfer portion. An inkjet printing system or an offset printing system may be adopted as an image forming unit.

Figure 2:
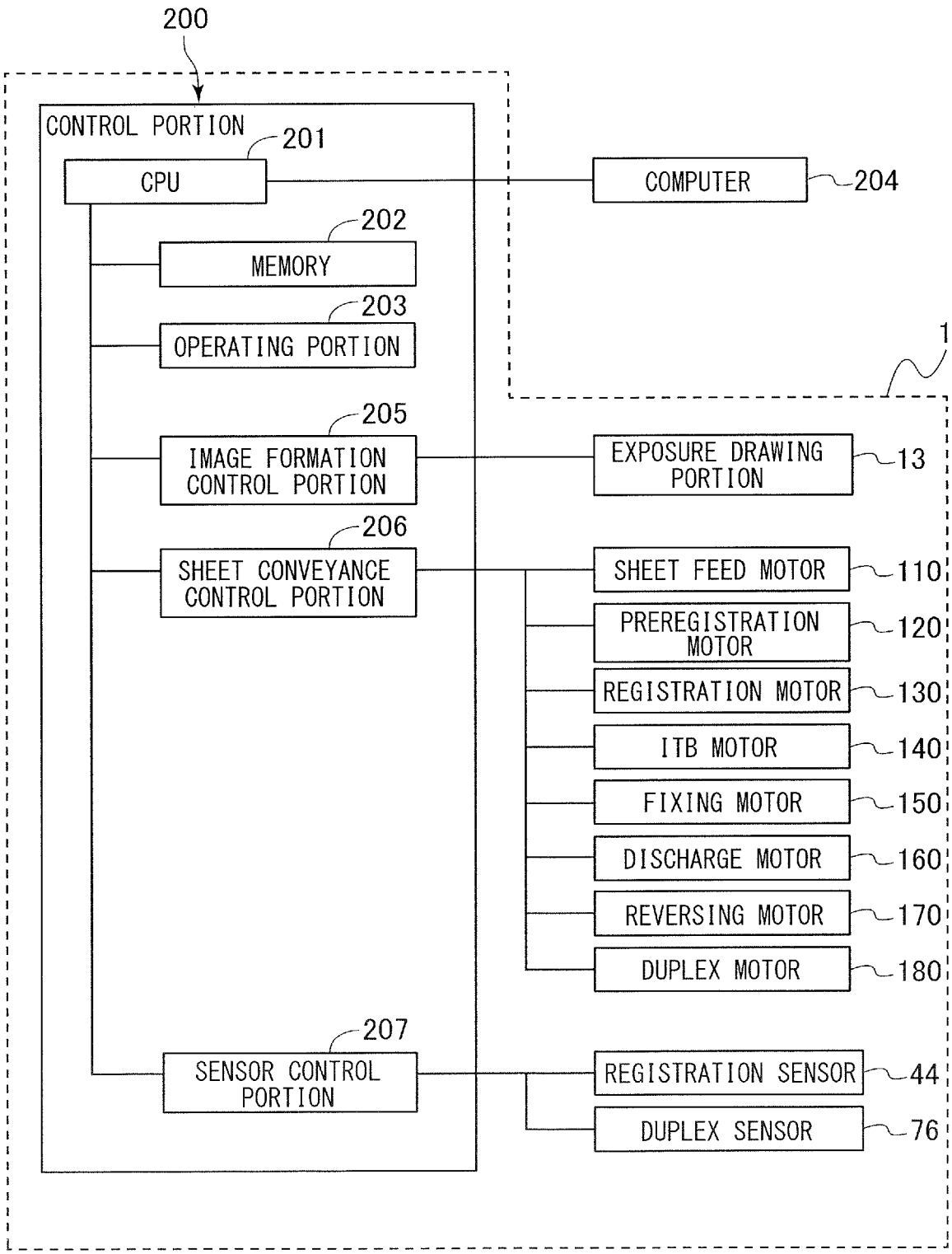
FIG. 2 is a block diagram illustrating a control configuration of the image forming apparatus of the first embodiment.

A control configuration for controlling functions of the image forming apparatus 1 will be described below with reference to a block diagram in FIG. 2. In the image forming apparatus 1, a controller 200 of the present embodiment is mounted. The controller 200 is provided with functioning portions including a central processing unit (CPU) 201, a memory 202, an operating portion 203, an image formation control portion 205, a sheet conveyance control portion 206 and others. The CPU 201 realizes various processing to be executed by the image forming apparatus 1 by reading a control program stored in the memory 202. The memory 202 includes a random access memory (RAM) and a read-only memory (ROM) for example and stores programs and data in predetermined storage areas. The operating portion 203 includes devices such as a liquid crystal panel and buttons and accepts operations performed by a user, such as input of information to be used in printing (e.g., size, grammage, surface nature and others of a sheet), and instructions such as execution of printing and of its interruption.

The image formation control portion 205 controls the image forming operation by giving instructions to respective portions of the image forming engine 10 including an exposure writing portion 13 which commands the exposure units 13Y, 13M, 13C and 13K to perform the image writing operation. The sheet conveyance control portion 206 commands a feed motor 110, a discharge motor 160 and other motors for driving conveyance rollers in order to control conveyance of the sheet P. The sensor control portion 207 controls start and stop of sensing by a registration sensor 44 and a duplex sensor 76 described later and receives detection results of these respective sensors. The controller 200 is also able to receive various information regarding the sheet used for printing from a computer 204 connected with the image forming apparatus 1 through a network.

Sheet Conveyance System

Figure 3:
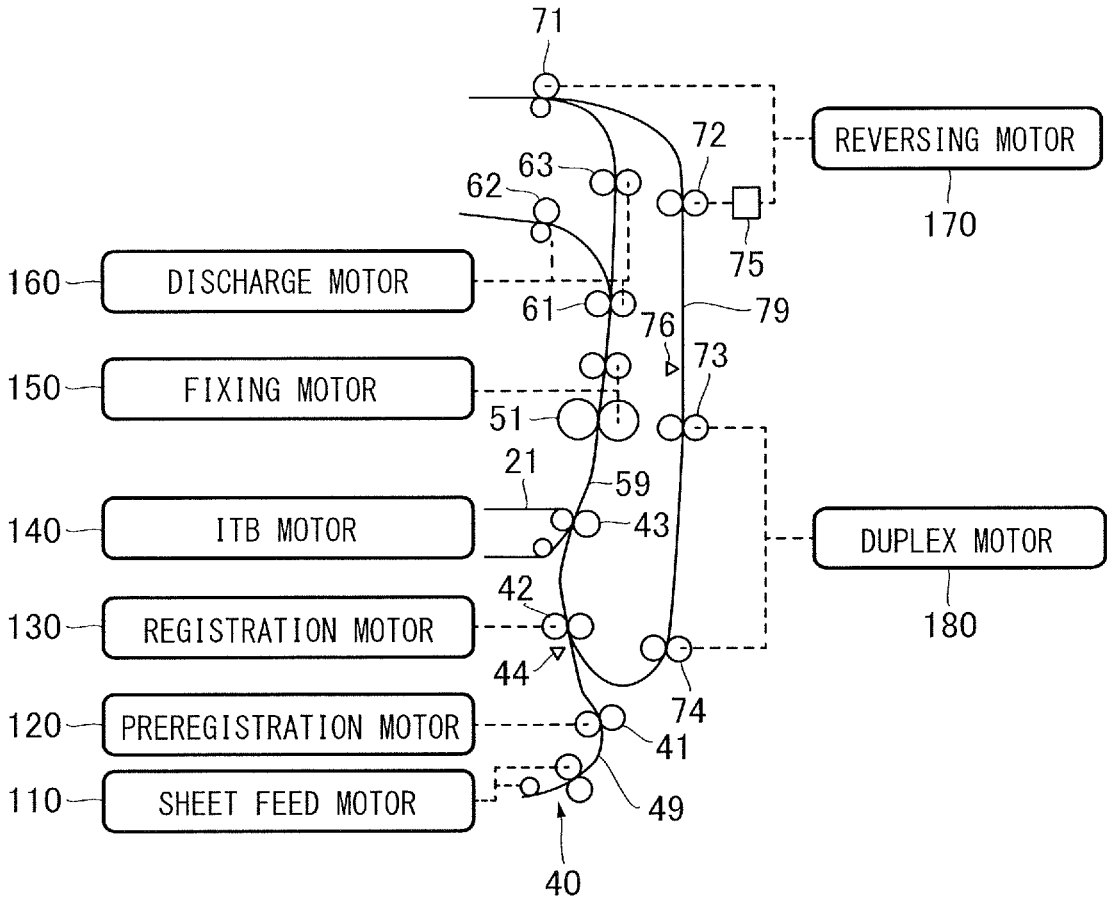
FIG. 3 is a diagram illustrating a driving configuration of a sheet conveyance system of the first embodiment.

Next, the sheet conveyance system and the driving structure controlled by the sheet conveyance control portion 206 of the present embodiment will be described with reference to FIG. 3. The sheet conveyance system provided in the image forming apparatus 1 includes a feed path 49, an image forming path 59 and the duplex conveyance path 79. Sheet conveyance spaces of these paths are defined by guide members supported by the apparatus body 100. A "sheet conveyance direction" in the following description refers to a major conveyance direction in a sheet conveyance path where a member that is related to the conveyance direction is disposed.

The feed path 49 is a conveyance path for feeding the sheet P and is provided with the feed unit 40 and the pre-registration roller pair 41. The feed unit 40 is driven by the feed motor 110, and the pre-registration roller pair 41 is driven by the pre-registration motor 120.

The image forming path 59 is a conveyance path for forming an image while conveying the sheet P and is provided with the registration roller pair 42, the secondary transfer roller 43, the secondary transfer inner roller 22 and the fixing roller pair 51. The registration roller pair 42 is driven by the registration motor 130, the secondary transfer inner roller 22 is driven by an intermediate-transfer-belt (ITB) motor 140 and the fixing roller pair 51 is driven by a fixing motor 150.

The duplex conveyance path 79 is a conveyance path for conveying the sheet P sent out of the image forming path 59 toward the image forming path 59 again in a case of executing the duplex printing and is provided with a first duplex roller pair 72, a second duplex roller pair 73 and a third duplex roller pair 74. The reverse conveyance roller pair 71 receives the sheet P from the image forming path 59, reverses and sends the sheet P to the duplex conveyance path 79. The first through third duplex roller pairs 72 through 74 are disposed in this order along a direction from the reverse conveyance roller pair 71 to the registration roller pair 42.

The reverse conveyance roller pair 71 and the first duplex roller pair 72 are driven by a reversing motor 170, and the second duplex roller pair 73 and the third duplex roller pair 74 are driven by a duplex motor 180. The reversing motor 170 is a motor rotatable in a first (or a normal) direction and in a second (or a reverse) direction opposite from the first direction, and the first duplex roller pair 72 is linked with the reversing motor 170 through a one-way clutch 75. The duplex sensor 76 serving as a detector capable of detecting the sheet is disposed between the first duplex roller pair 72 and the second duplex roller pair 73 in the sheet conveyance direction. The registration sensor 44 serving as another detector is disposed at a position in a vicinity of and upstream of the registration roller pair 42. Photoelectric sensors configured to detect a sheet when light is blocked by the sheet may be used for these sensors 44 and 76.

The image forming path 59 is an exemplary first conveyance path on which the image forming unit is disposed. The duplex conveyance path 79 is an exemplary second conveyance path guiding the sheet reversed by the reverse conveyance roller pair 71 or its equivalent toward the first conveyance path. The reverse conveyance roller pair 71 is an exemplary first conveyance member reversing and conveying the sheet from the first conveyance path. The first duplex roller pair 72, the second duplex roller pair 73 and the third duplex roller pair 74 are respective examples of a second conveyance member, a third conveyance member and a fourth conveyance member disposed on the second conveyance path in this order along the sheet conveyance direction. The reversing motor 170 is an exemplary first driving source driving the first and second conveyance members. The duplex motor 180 is an exemplary second driving source driving the third and fourth conveyance members. The registration motor 130 is an exemplary third driving source driving the registration member.

Besides them, there is provided a discharge motor 160 driving the conveyance roller pairs 61 through 63 composing the sheet discharge portion 60. It is noted that a sheet conveyance operation described below is also applicable to a configuration in which the reverse conveyance roller pair 71 functions also as a discharge member discharging the sheet P, i.e., a configuration in which the sheet discharge portion is omitted.

Waiting State

Next will be described a case where a sheet is made to wait on the upstream side of a transfer portion, e.g., the secondary transfer portion in the present embodiment, during when duplex printing is executed. In a case of executing the duplex printing on a plurality of sheets, images are basically transferred on the sheets at certain intervals, i.e., at image forming intervals, in accordance to a printing sequence described later. This interval defines the number of sheets outputted per unit time, i.e., productivity of the image forming apparatus. However, because of various reasons as described below, there is a case where an image forming process is temporarily stopped and the image forming interval is prolonged while accepting a drop of the productivity.

For instance, there is a case where conveyance of a sheet to the transfer portion and the fixing unit is stopped to assure a cooling time in a case where temperature of the fixing unit has excessively increased and exceeds a tolerance limit temperature. There is also a case where the image forming process is stopped to wait for a processing operation of a sheet processor, which is attached and connected downstream of the sheet discharge roller and performs a process such as stapling of the sheets. There is also a case where a time, e.g., an image loading time, is required for the controller of the image forming apparatus to process image data transferred from a computer into a data format supported by the image forming unit (i.e., a data format that can be transferred to the exposure writing portion 13).

When the image forming process is stopped, a new image writing operation is not started in the image forming units PY through PK, and the sheet P is made to wait on the upstream side of the secondary transfer portion. In a case where the image forming process is delayed by any reason as described above, the controller 200 may determine to delay the image forming process right before the exposure writing portion 13 starts the image writing operation depending on timing when the abovementioned situation occurs. Therefore, the sheet P may be made to wait before an image is formed on the first surface (front surface) thereof, and/or made to wait before an image is formed on the second surface (back surface) thereof. It is noted that from an aspect of improving the productivity of the image forming apparatus 1, a time lag from when the controller 200 determines that the image writing operation can be carried out till when the exposure units 13Y through 13K actually start the image writing operation is shortened as much as possible.

Meanwhile, a time lag from the start of the image writing operation till when the image transfer process on the sheet P is executed depends on a physical structure for conveying the toner image and the sheet P to the secondary transfer portion. For instance, the faster the rotational speed, i.e., a processing speed, of the photosensitive drum 11 and the intermediate transfer belt 21 and/or the shorter a moving distance in which a latent image drawn on the photosensitive drum 11 by the exposure units 13Y through 13K is developed and moved finally to the secondary transfer portion, the smaller the time lag is. In the same time, the larger a conveyance speed of the sheet P and/or the shorter a conveyance distance from the registration roller pair 42 serving as a waiting position of the sheet P to the secondary transfer portion, the shorter the time lag is.

In order to meet the demands for improvement of productivity and for downsizing of the image forming apparatus 1, a distance from the most downstream primary transfer roller in the rotation direction of the intermediate transfer belt 21, i.e., the black transfer roller 25, to the secondary transfer roller 43 is minimized also in the present embodiment. A distance from the registration roller pair 42 to the secondary transfer roller 43 is minimized and is set to be approximately equalized with the distance from the most downstream primary transfer roller 25 to the secondary transfer roller 43.

In a case where the image writing operation on the image forming units PY through PK is not permitted to start, the sheet P is made to wait at the registration roller pair 42. As soon as the image writing operation is permitted, the electrostatic latent image begins to be drawn and the sheet P begins to be conveyed approximately simultaneously by the registration roller pair 42. Then, the toner image is transferred onto the sheet P at the secondary transfer portion. The timing of starting the image writing operation and the timing of restarting conveyance of the sheet P are controlled so that displacement of the images transferred onto the sheet P does not occur at the secondary transfer portion.

Circulation of Sheets

Figure 4A:
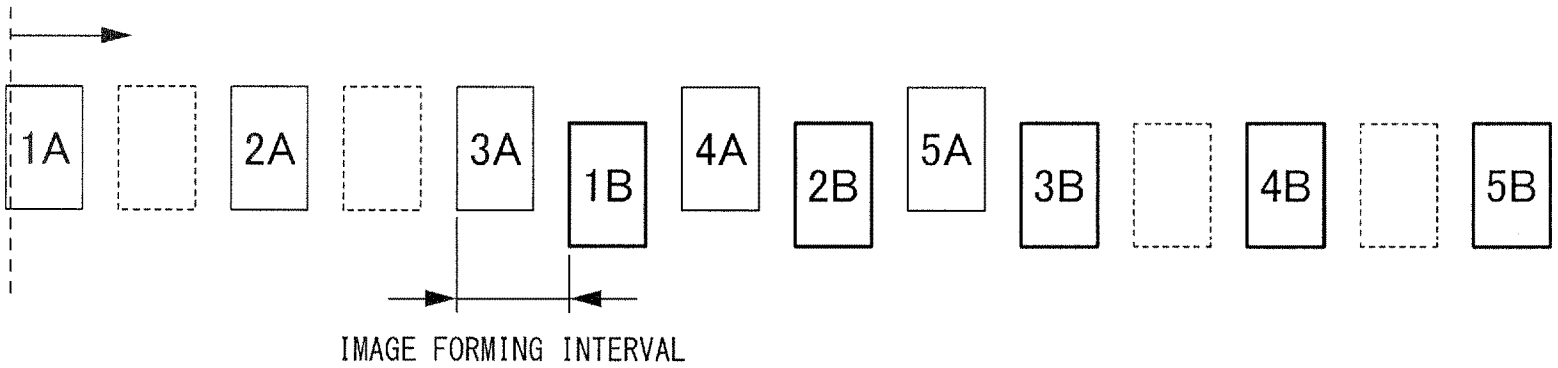
FIG. 4A is a conceptual diagram illustrating an image forming sequence in executing duplex printing on small-size sheets in the image forming apparatus of the first embodiment.
Figure 4B:
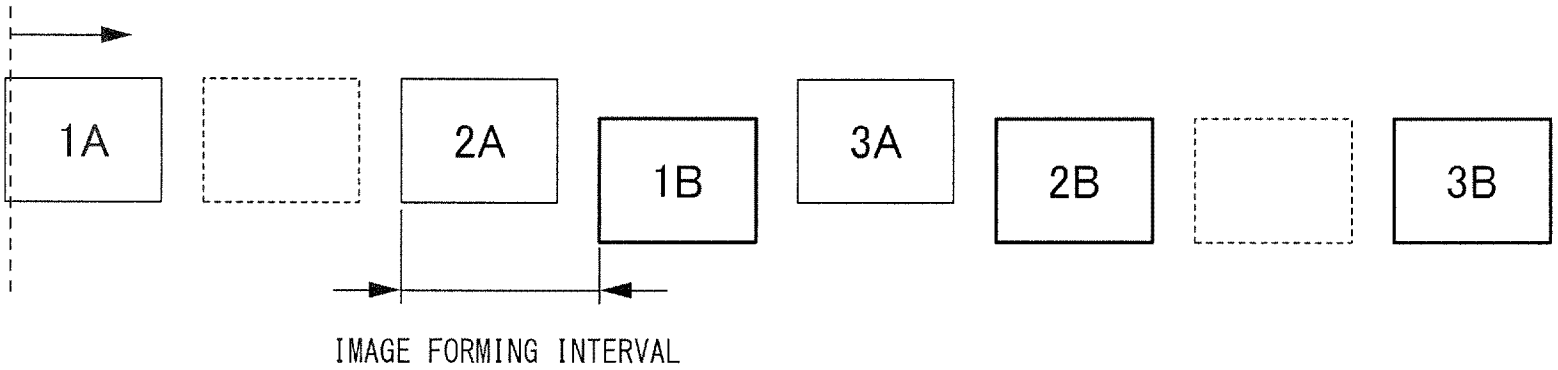
FIG. 4B is a conceptual diagram illustrating an image forming sequence in executing duplex printing on large-size sheets in the image forming apparatus of the first embodiment.
Figure 4C:
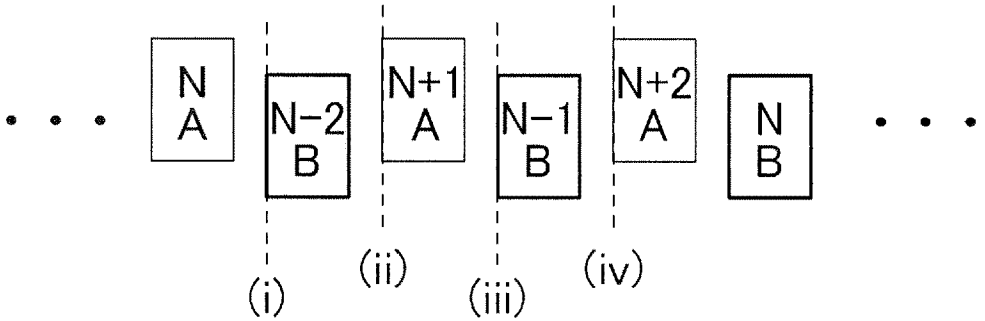
FIG. 4C is a conceptual diagram illustrating an image forming sequence in executing duplex printing on a large number of small-size sheets in the image forming apparatus of first embodiment.
Figure 5A:
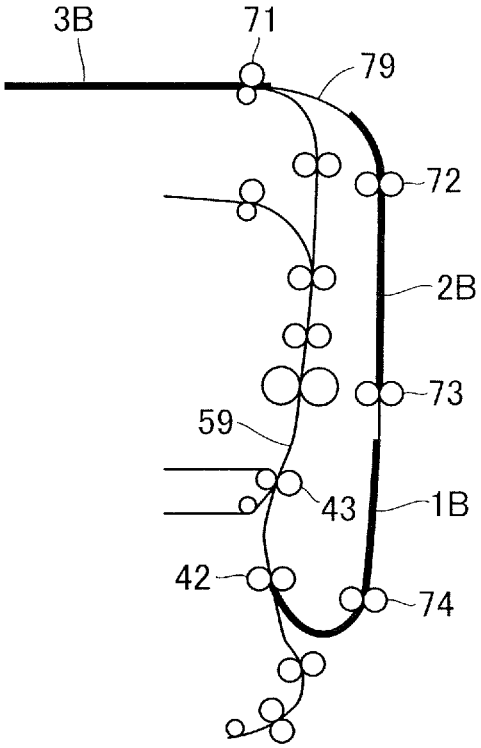
FIG. 5A is a schematic diagram indicating sheet waiting positions in executing the duplex printing on the small-size sheets in the image forming apparatus of the first embodiment.
Figure 5B:
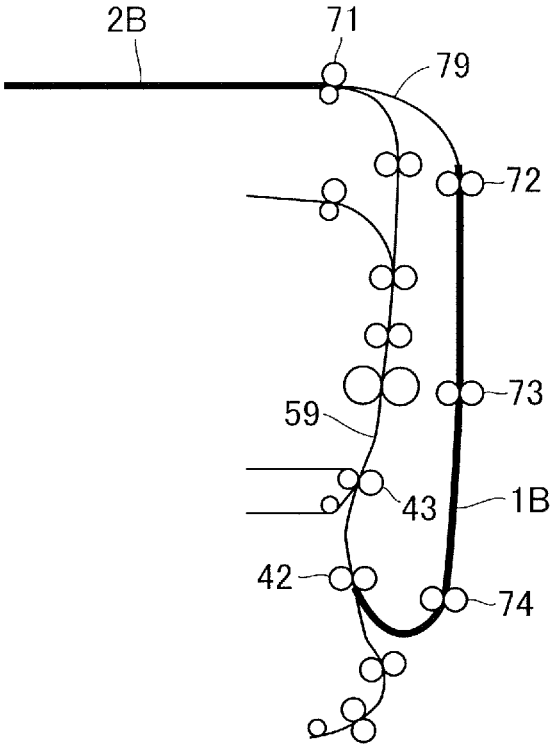
FIG. 5B is a schematic diagram indicating sheet waiting positions in executing the duplex printing on the large-size sheets in the image forming apparatus of the first embodiment.

Next, sheet circulation in the duplex printing will be described. FIGS. 4A and 4B are conceptual diagrams illustrating sequences of executing the image forming operations, and indicate that the images are transferred when passing through the secondary transfer portion (indicated by a broken line) sequentially from sheets on a left side in the diagrams with elapse of time. FIGS. 5A and 5B are schematic diagrams illustrating conditions in which a maximum number of sheets are waiting during the duplex printing. FIGS. 4A and 5A illustrate a case of executing the duplex printing on small-size sheets of which a length in the sheet conveyance direction is relatively small, and FIGS. 4B and 5B illustrate a case of executing the duplex printing on large-size sheets of which a length in the sheet conveyance direction is relatively large. The small-size sheet is exemplified by A4 (210 mm) and Letter (215.9 mm) size sheets, and the large-size sheet is exemplified by A3 (420 mm) and Ledger (431.8 mm) size sheet. FIG. 4C will be explained below.

As for reference numerals such as '3A', and '1B', the numbers specify particular sheets, and the alphabet 'A' indicates a condition of the sheet which is not reversed yet and the 'B' indicates a condition of the sheet which has been reversed. For instance, '3A' indicates a thirdly fed sheet that is not reversed yet, and '1B' indicates a firstly fed sheet which has been reversed.

As illustrated in FIG. 4A, an image is formed on a back side of the first sheet (1B) after sequentially forming images on front sides of three sheets (1A through 3A) in the case of the small-size sheet. After that, the image forming processes on the front side and the back side are alternately executed like (1B, 4A, 2B, 5A, . . . ) and the duplex printing of the five sheets is completed by consecutively forming images on the back sides (3B through 5B) of the final three sheets. In a case where the duplex printing is executed on six or more sheets, a period during which the front side and the back side are alternately printed is extended.

Here, suppose an example case where the waiting process is executed regarding the back side of the first sheet (1B), i.e., a case where the image writing operation as for an image to be printed on the back side of the first sheet (1B) is not permitted to start and the sheet has to wait at the registration roller pair 42. This is a case where an image forming interval between the sheet (3A) and the sheet (1B) is prolonged. In this case, the first sheet (1B) is made to wait while abutting with the registration roller pair 42 as illustrated in FIG. 5A. In addition, if a waiting time of the first sheet (1B) is long, the succeeding second and third sheets (2B and 3B) are also needed to wait at any positions on the conveyance path.

That is, in the case of the small-size sheets, up to three sheets may need to be kept waiting. Accordingly, the reverse conveyance portion 70 serving as a re-conveyance path from the reverse conveyance roller pair 71 to the registration roller pair 42 through the duplex conveyance path 79 is constructed to have a length capable of accommodating three sheets. It is noted that in a case where the image forming process on the front side of the fifth sheet (5A) is stopped, the sheets that have to wait in the reverse conveyance portion 70 are two sheets of the third and fourth sheets (3B and 4B). It is because the first and second sheets (1B and 2B) are discharged out of the image forming apparatus 1.

As described above, there is a case where a go/no-go decision for the image writing operation is made right before when the sheet P arrives at the registration roller pair 42. In a case where this sheet P is in a state just before an image is formed on the second surface thereof, after when the first sheet (1B) in the duplex conveyance path 79 is stopped at first, the second sheet (2B) and then the third sheet (3B) are stopped. Therefore, it is necessary to independently control conveyance of the three sheets. In the same time, in order to make the three sheets wait in the conveyance path whose length from the reverse conveyance roller pair 71 to the registration roller pair 42 through the duplex conveyance path 79 is limited, it is required to shorten the intervals between the sheets in the waiting state by stopping conveyance of the succeeding sheet after stopping conveyance of the preceding sheet. It is also possible to improve productivity after restarting conveyance by minimizing the intervals of the sheets in the waiting state as much as possible. Note that it is preferable to make the third sheet (3B) wait at a position fully separated from the image forming path 59 in order to avoid troubles such as deterioration of an image or pasting of the sheets otherwise caused by the heat of the fixing unit. Thus, the third sheet (3B) is made to wait in a condition held by the reverse conveyance roller pair 71 in the present embodiment.

In order to independently control conveyance of such three sheets, it is conceivable to provide three driving sources like motors. In such configuration, each driving source handles one sheet and stops to drive when the sheet arrives at a predetermined sheet position (waiting position). However, it is costly to provide a number of driving sources. Because a cost of motors occupies a significant part of an overall cost of the product, it is preferable to be able to reduce the number of driving sources while assuring the functions for considerably cutting down the cost.

Therefore, the present embodiment adopts a configuration of making a predetermined number of sheets, e.g., three sheets, wait at desirable positions by a lower number of driving sources, e.g., two driving sources, which is less than the predetermined number of sheets. A specific configuration and operations thereof will be detailed later.

Still further, in the present embodiment, a sheet waiting position in the reverse conveyance portion 70 is changed depending also on whether the sheet P waiting at the registration roller pair 42 is a first surface or a second surface. A description about this arrangement makes it possible to appropriately control the sheet position so as to minimize a possibility of causing trouble such as conveyance failure of the sheet will be also made.

Figure 6:
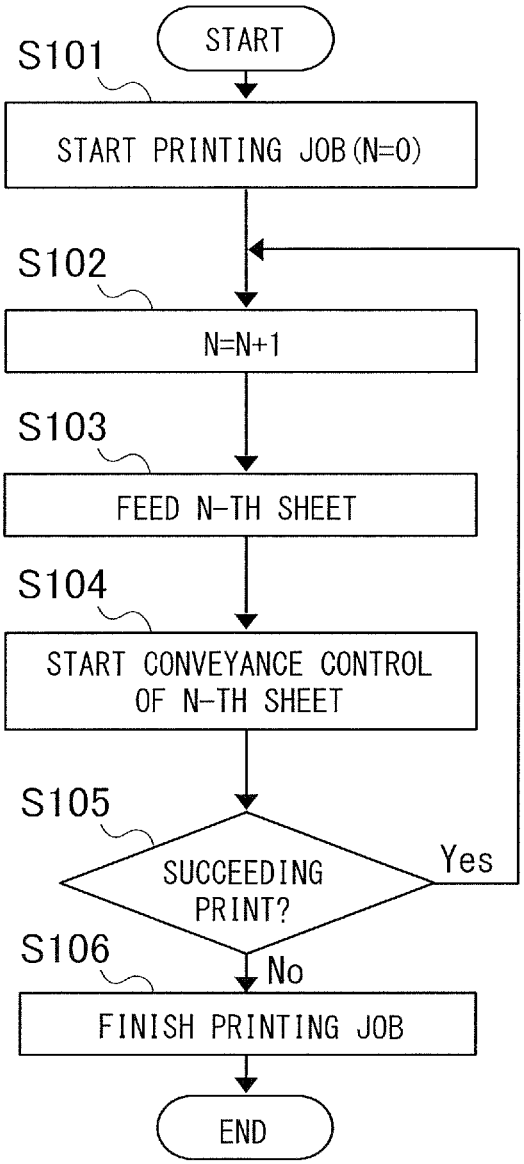
FIG. 6 is a flowchart illustrating an overall flow of a method for controlling a print job of the first embodiment.

A method for conveying sheets will be described below with reference to FIGS. 6 through 13, in which three sheets are made to wait as necessary by the registration motor 130, the reversing motor 170 and the duplex motor 180. FIG. 6 is a flowchart of an overall conveyance operation, and FIG. 7 is a flowchart indicating contents of control performed on each sheet.

Figure 7:
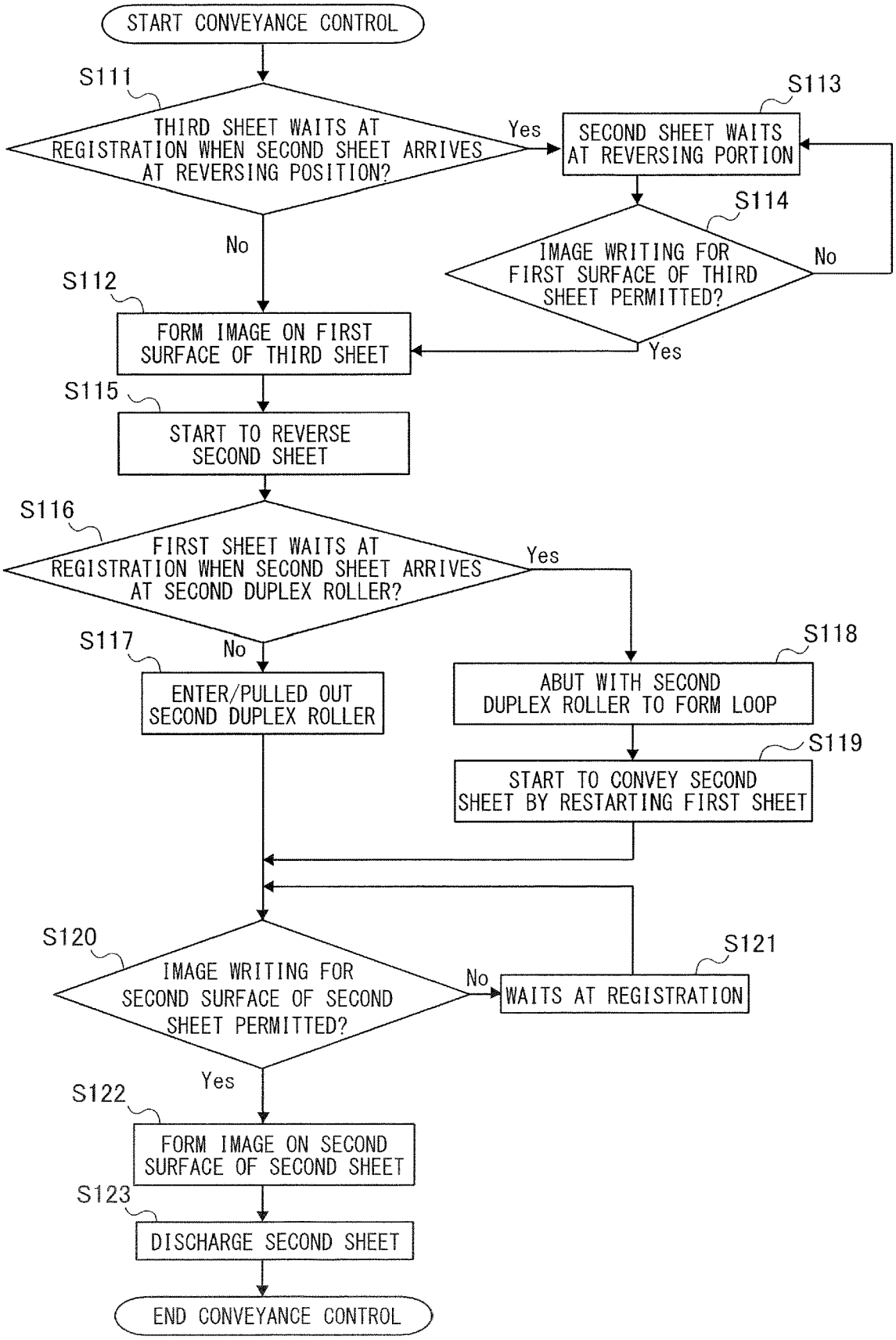
FIG. 7 is a flowchart of a conveyance control performed on each sheet in the print job of the first embodiment.

Each step of the flowcharts in FIGS. 6 and 7 is achieved by the CPU 201 of the controller 200 (see FIG. 2) controlling components of the image forming apparatus 1 through responsible functional blocks such as the image formation control unit 205, the sheet conveyance control unit 206 and the sensor control unit 207. These flowcharts are executed when a user instructs the apparatus to execute a printing job through the operating portion 203 of the image forming apparatus 1 or through the computer 204 connected with the image forming apparatus 1 directly or through a network. The user can specify a number of pages per copy or a number of copies to be printed by the printing job and information of the sheet to be used for printing such as sheet attributes including size and grammage and a cassette serving as a sheet supply source.

When the controller 200 accepts the printing job and starts to execute the job in Step S101, a sheet is fed sequentially starting with the first sheet (N=1) in Steps S102 and S103. The conveyance operation of each sheet is controlled in Step S104 on a reference second sheet by making reference to conditions of a preceding first sheet and of a succeeding third sheet in accordance to the flowchart in FIG. 7. Note that if the conveyance operation of each sheet is configured to realize in accordance with the flowchart in FIG. 7, it is not necessary to implement as a program of parallel processing. When a number of sheets required in the printing job has been fed and the image forming processes on those sheets have been completed, i.e., No in Step S105, the printing job finishes in Step S106.

A method for controlling the conveyance operation targeting each sheet will be described below along the flowchart in FIG. 7. It is noted that while the conveyance operation targeting the second sheet will be described here, a sheet fed from the feed path 49 prior to the target sheet may be replaced as a first sheet and a sheet fed from the feed path 49 succeeding to the target sheet may be replaced as a third sheet. That is, "the first sheet", "the second sheet" and "the third sheet" are what represent relative sequences when the respective sheets are fed through the feed path 49. Also as a precondition, assume that image forming processes on the first surfaces of the first and second sheets have been finished and the conveyance control described here will be started in a state in which the first sheet waits in the reverse conveyance portion.

When the second sheet arrivals at a reverse position of the reverse roller pair 71, a go/no-go decision for the image writing operation for the first surface of the third sheet is made in Step S111. The reverse position of the reverse roller pair 71 refers to a turning position where the second sheet can be conveyed to the duplex path 79 as the reverse roller pair 71 conveys the second sheet by a predetermined distance in the normal direction i.e., in a first direction, and rotates in the reverse direction, i.e., in a second direction. In a case where it is determined that the writing operation can be made (permitted) in Step S111, the image forming process on the first surface of the third sheet is executed in Step S112 without making the third sheet wait at the registration roller pair 42. That is, the registration motor 130 starts to drive such the third sheet is conveyed keeping a predetermined interval to the second sheet after the registration roller pair 42 has corrected a skew of the third sheet. The predetermined interval corresponds to a distance between the "2A" and the "3A" which brings about maximum productivity of the image forming apparatus in FIG. 4A.

If the writing operation is not permitted, i.e., Yes in Step S111, the third sheet is made to wait at the registration roller pair 42. That is, the drive of the registration motor 130 is not started even if the second sheet is more distant more] than the predetermined distance. At this time, the second sheet waits at the reverse portion in Step S113 and continuously waits until a permission of image writing operation for the first surface of the third sheet is issued in Step S114. The reverse portion refers to a part such as a conveyance member and a conveyance guide used for the reversal of the sheet among the reverse conveyance portion 70, and the reverse roller pair 71 composes the reverse portion in the present embodiment. When the permission of image writing operation for the third sheet is issued in Step S114, the image forming process on the first surface of the third sheet is executed in Step S112.

When a leading edge of the third sheet arrives at a predetermined position, i.e., the secondary transfer portion in the present embodiment, after starting the image on the third sheet, the second sheet is started to be conveyed toward the duplex path 79 in Step S115 and is then conveyed into the duplex path 79. Then, at timing when the second sheet arrives at the second duplex roller pair 73, an operation thereafter is switched depending on whether the preceding first sheet waits at the registration roller pair 42 in Step S116.

In a case where the first sheet does not wait at the registration roller pair 42, i.e., No in Step S116, a mode of not performing the waiting process of the second sheet, i.e., a second mode, is selected. In this case, the object sheet enters the second duplex roller pair 73 being driven, is pulled out by the second duplex roller pair 73 and is continuously conveyed toward the registration roller pair 42 in Step S117. The second sheet arriving at the registration roller pair 42 waits for a permission of writing an image on the second sheet in Steps S120 and S121 and is conveyed to the secondary transfer portion to form the image on the second surface in Step S122.

Meanwhile, in a case where the first sheet waits at the registration roller pair 42, i.e., in a case where the process in Step S121 is being executed on the first sheet, a mode of waiting process in Step S118 of making the second sheet to wait after conveying to a predetermined position, i.e., a first mode, is selected. In this case, the second sheet is conveyed by the first duplex roller pair 72 to a position abutting with the second duplex roller pair 73 being stopped. After that, when the conveyance of the preceding sheet is restarted by the duplex motor 180, the conveyance of the object sheet is restarted by the second duplex roller pair 73 driven also by the duplex motor 180 in Step S119. Then, the second sheet arriving at the registration roller pair 42 waits for a permission of writing an image on the second sheet in Steps S120 and S121 and is conveyed to the secondary transfer portion to form the image on the second surface in Step S122.

Behaviors of the sheets and drive controls of the motors, in the cases where the waiting process is not executed, the waiting process on the first surface (i.e., waiting process in performing image formation on the first surface of a sheet) is executed, and the waiting process on the second surface is executed, will be described below with reference to FIGS. 8A through 13. It is noted that in the following description, the first through third sheets are common with those in the flowchart in FIG. 7.

Case 1: Waiting Process Is Not Carried Out

Figure 8A:
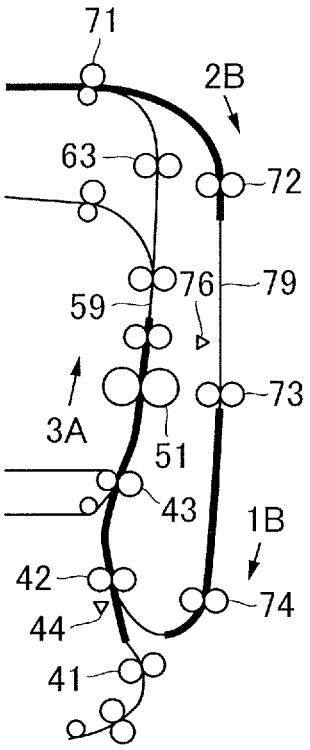
FIG. 8A is a schematic diagram indicating one state of the duplex printing operation in a case where no waiting process is executed in the image forming apparatus of the first embodiment.
Figure 8B:
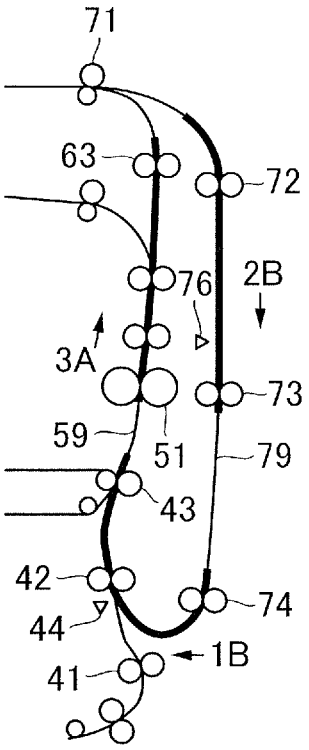
FIG. 8B is a schematic diagram indicating another state of the duplex printing operation in the case where no waiting process is executed in the image forming apparatus of the first embodiment.

FIGS. 8A and 8B illustrate the conveyance operations in cases where no waiting process is executed. Because the image writing operation for the first surface of the third sheet (3A) is enabled before the second sheet (2B) arrives at the reverse roller pair 71, no waiting process of the first surface is performed (No in Step S111). After temporarily stopping at the registration roller pair 42, the third sheet (3A) is started to be conveyed by keeping a predetermined distance from a trailing edge of the preceding sheet (here the second sheet) as illustrated in FIG. 8A. The second sheet (2B) is conveyed to the first duplex roller pair 72 by the reverse motor 170 into which a stop signal is inputted for a predetermined time, e.g., 100 ms of settling time, after rotating normally by a predetermined amount and then is rotated reversely.

Still further, because the image writing operation for the first sheet (1B) is enabled before the leading edge of the second sheet after the reversal (2B) arrives at the second duplex roller pair 73 in this case, the waiting process of the second surface is not also performed, i.e., No in Step S120. The first sheet (1B) is temporarily stopped at the registration roller pair 42 and is then started to be conveyed by keeping a predetermined distance from a trailing edge of the third sheet (3A) as illustrated in FIG. 8B. The second sheet (2B) is conveyed toward the third duplex roller pair 74 so as to follow the first sheet (1B) in the duplex path 79.

Figure 9:
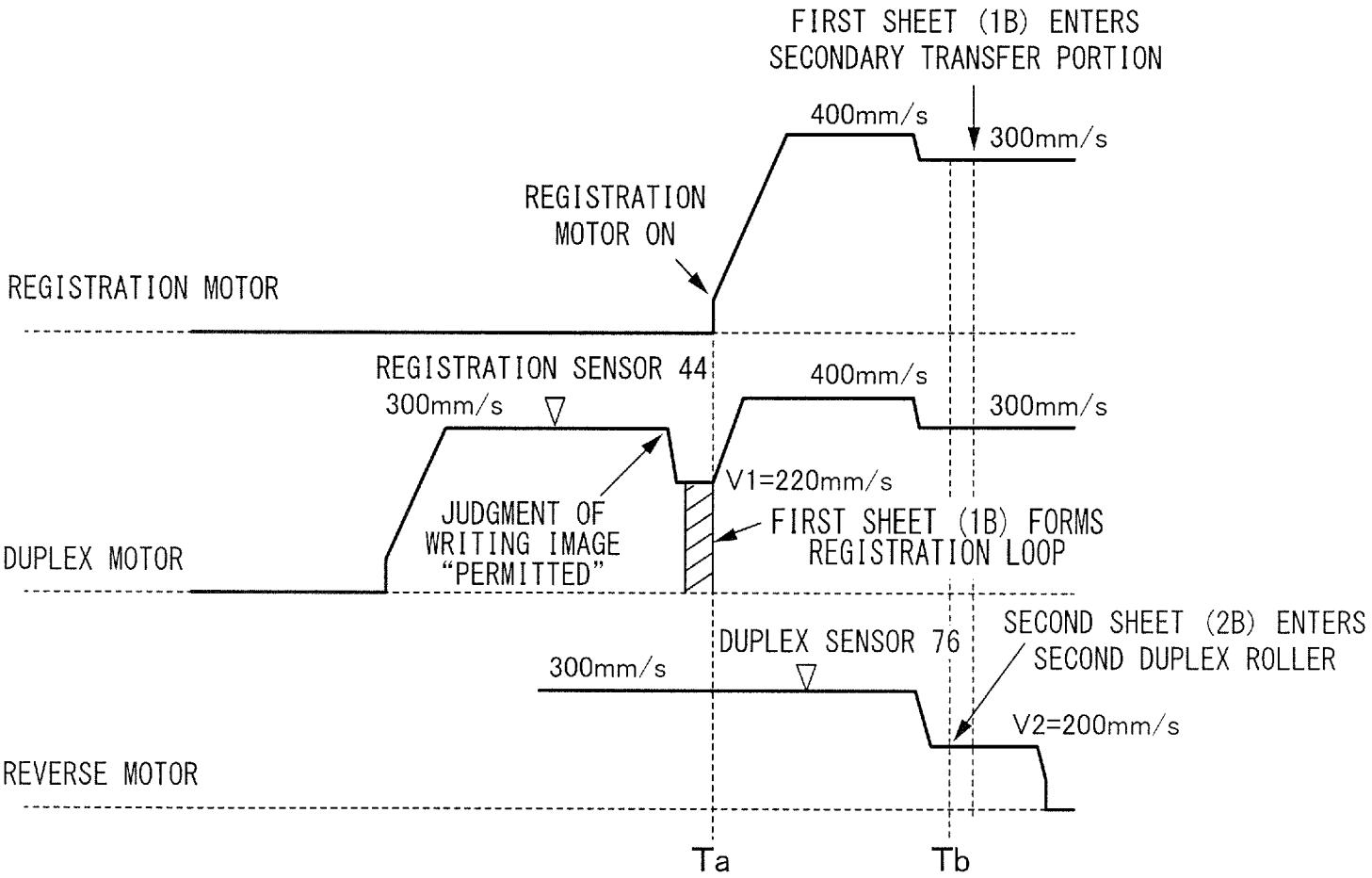
FIG. 9 is a timing chart indicating driving states of the respective motors in the case where no waiting process is executed in the image forming apparatus of the first embodiment.

FIG. 9 illustrates a timing chart of each motor involved in the conveyance control of the first and second sheets in the duplex path 79. After temporarily stopping the first sheet (1B) upstream of the registration roller pair 42, the duplex motor 180 drives the second and third duplex roller pairs 73 and 74 with speed, i.e., peripheral speed, of 300 mm/s after starting the image forming process of the third sheet (3A). Thereby, the first sheet (1B) is conveyed toward the registration roller pair 42 so as to keep a predetermined distance from the third sheet (3A) on which the image forming process is performed as illustrated in FIG. 8A.

When the registration sensor 44 detects the first sheet (1B), the third duplex roller pair 74 is decelerated to a conveyance speed of V1 to cause the sheet to form a loop (i.e., flexibly deflected). The first sheet (1B) abuts with the registration roller pair 42 being stopped and forms the loop to correct a skew thereof. The conveyance speed is V1=220 mm/s in the present embodiment, and timing when the driving speed of the duplex motor 180 is decelerated is approximately equal to timing when a go/no-go decision on an image writing operation for the second surface of the first sheet (1B) is made. When the decision result of the image writing operation is "permitted" (enabled), the registration motor 130 starts to drive at time Ta when the first sheet (1B) forms a predetermined amount of loop, and the registration roller pair 42 starts to convey the first sheet (1B).

Here, in order to improve the productivity of the image forming apparatus 1, the conveyance speed, e.g., 400 mm/s, of the registration roller pair 42 before a sheet arrives at the secondary transfer portion is set to be a value larger than a conveyance speed, e.g., a processing speed 300 mm/s, at the secondary transfer portion. The registration motor 130 is accelerated to a speed corresponding to the speed of 400 mm/s and is decelerated to 300 mm/s until the sheet arrives at the secondary transfer portion.

Because the case where the image writing operation for the first sheet (1B) is permitted before time Tb when the second sheet (2B) arrives at the second duplex roller pair 73 is assumed here, the duplex motor 180 is not stopped and is accelerated again in accordance to drive starting time Ta of the registration motor 130. That is, the duplex motor 180 is accelerated again such that the third duplex roller pair 74 rotates with the peripheral speed of 400 mm/s equal to the target speed of the registration roller pair 42 and is decelerated in accordance with the deceleration of the registration motor 130. The conveyance speed of the first sheet (1B) is thus controlled by the registration roller pair 42 and the third duplex roller pair 74.

Meanwhile, the second sheet (2B) is conveyed with a predetermined speed, e.g., 300 mm/s, succeeding to the first sheet (1B) by the first duplex roller pair 72 that is driven by the reversing motor 170 rotating reversely (see FIG. 8A). After detecting the leading edge of the second sheet (2B) by the duplex sensor 76, the reversing motor 170 is decelerated such that a conveyance speed V2 of the first duplex roller pair 72 when the second sheet (2B) enters the second duplex roller pair 73 becomes 200 (mm/s).

Here, the second duplex roller pair 73 is driven with the conveyance speed, i.e., 300 mm/s, greater than that of the first duplex roller pair 72, and a one-way clutch 75 is also provided between the reverse motor 170 and the first duplex roller pair 72. Due to that, when the second sheet (2B) enters the second duplex roller pair 73, the one-way clutch 75 slides and the second sheet (2B) is pulled out of the first duplex roller pair 72 (see FIG. 8B). Still further, even if the distance between the sheets is short as compared to that of the timing chart in FIG. 9 and the second sheet (2B) enters the second duplex roller pair 73 during when the first sheet (1B) forms a loop, the succeeding sheet (2B) is smoothly pulled out because V2>V1. That is, the second sheet (2B) is smoothly passed even in the state in which the duplex motor 180 is driven faster than the reverse motor 170, and the first and second sheets (1B) and (2B) are conveyed by the driving force of the duplex motor 180.

It is noted that even if the reversing motor 170 rotates normally after the second sheet (2B) is passed to the second duplex roller pair 73, no driving force is transmitted to the second duplex roller pair 73 by the action of the one-way clutch 75. Therefore, after the second sheet (2B) enters the second duplex roller pair 73, the second sheet (2B) is not hampered from being pulled out even if the reversing motor 170 is normally rotated. Accordingly, this arrangement makes it possible for the reverse conveyance roller pair 71 to start a reverse conveyance by receiving a next third sheet (3A) by normally rotating the reversing motor 170 before the third sheet (3A) arrives at the reverse conveyance roller pair 71 as illustrated in FIG. 8B.

Case 2: Waiting Process of First Surface is Carried Out

Figure 10A:
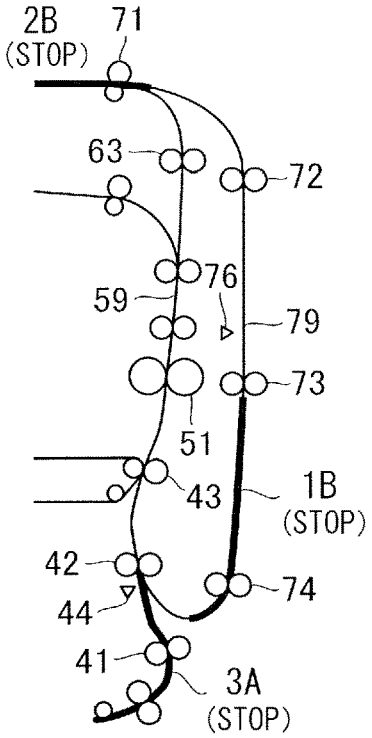
FIG. 10A is a schematic diagram illustrating a step of a duplex printing operation in a case of executing the waiting process in printing on a first surface in the image forming apparatus of the first embodiment.

Next, operations in the case where the waiting process on the first surface is executed will be described. FIGS. 10A through 10D illustrate a case where a result of Step S111 in FIG. 7 is Yes, i.e., an operation in a case where the second sheet (2B) waits at the reverse portion. FIG. 11 is a timing chart of the respective motors involved in the conveyance control of the first through third sheets. In FIG. 11, however, a sheet conveyance direction in the duplex path 79 related to the reverse motor 170 is indicated by a positive conveyance speed and a conveyance direction before the reverse roller pair 71 reverses a sheet is indicated by a negative conveyance speed.

In this case, even if the second sheet (2B) arrives at the reverse roller pair 71, no permission of the image writing operation for the first surface of the third sheet (3A) is issued and the waiting process of the first surface is executed, i.e., Yes in Step S111. As illustrated in FIG. 11, after the first sheet (1B) arrives at the waiting position of the duplex path 79 and the duplex motor 180 stops driving at T1, the third sheet (3A) is put in the waiting state without permitting the image writing operation for the first surface at T2. That is, the pre-registration motor 120 stops at the time T2 when the third sheet (3A) abuts with the registration roller pair 42 being stopped by the pre-registration roller pair 41 (see FIG. 3) and forms a loop, and the halt condition of the registration motor 130 is kept.

While the second sheet has been conveyed to the reverse roller pair 71 at the point of time when the pre-registration motor 120 stops driving, the conveyance is stopped after the sheet trailing edge arrives at a branch portion from the image forming path 59 to the duplex path 79 at T3. That is, the reverse motor 170 stops at the time T3 in a state in which the trailing edge of the second sheet approaches to a nip position of the reverse roller pair 71 by a predetermined distance, e.g., 30 mm. Thereby, the first through third sheets are put into stopped states (corresponds to T4 in FIG. 11), respectively, as illustrated in FIG. 10A.

Figure 10B:
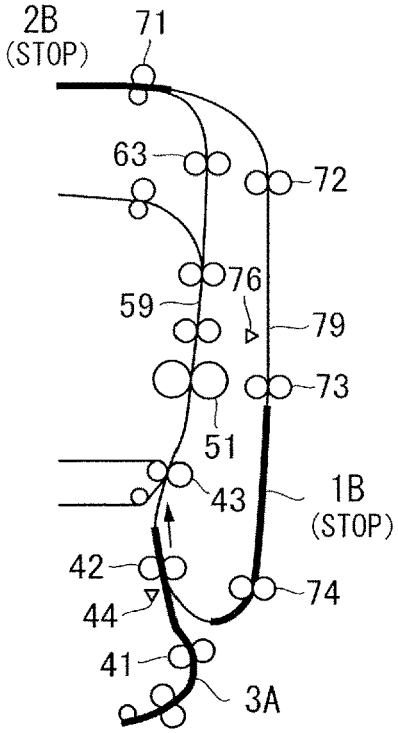
FIG. 10B is a schematic diagram illustrating a step following the step in FIG. 10A.
Figure 10C:
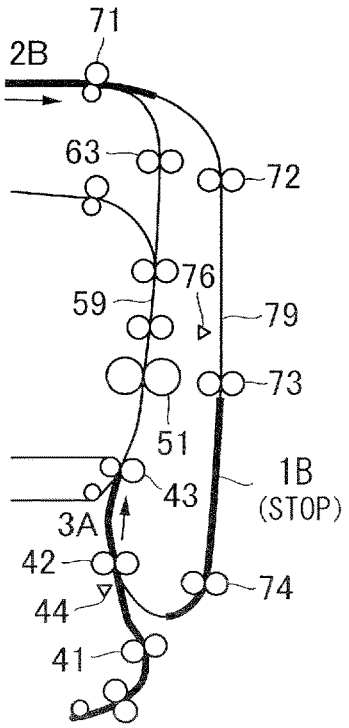
FIG. 10C is a schematic diagram illustrating a step following the step in FIG. 10B.

After that, when the image writing operation for the first surface of the third sheet (3A) is permitted, the pre-registration motor 120 and the registration motor 130 start to drive at time T5 at first and the third sheet (3A) is sent to the secondary transfer portion (see FIG. 10B). When the third sheet (3A) is conveyed by a predetermined distance, e.g., the third sheet (3A) enters the secondary transfer portion, the reverse motor 170 starts to reverse at time T6 and the second sheet (2B) is conveyed into the duplex path 79 (see FIG. 10C). Still further, the duplex motor 180 starts to drive so as to keep a predetermined distance from a trailing edge of the third sheet (3A) at time T7, and the first sheet (1B) is conveyed toward the registration roller pair 42 (see FIG. 10D).

Figure 10D:
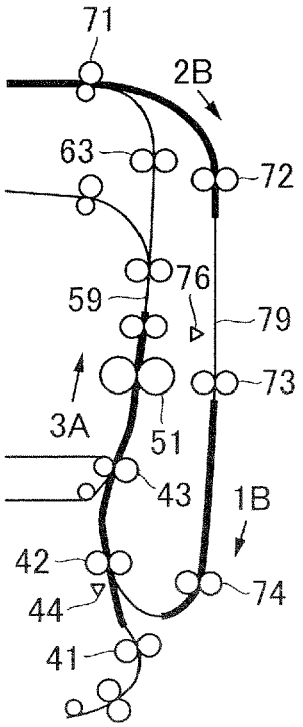
FIG. 10D is a schematic diagram illustrating a step following the step in FIG. 10C.
Figure 11:
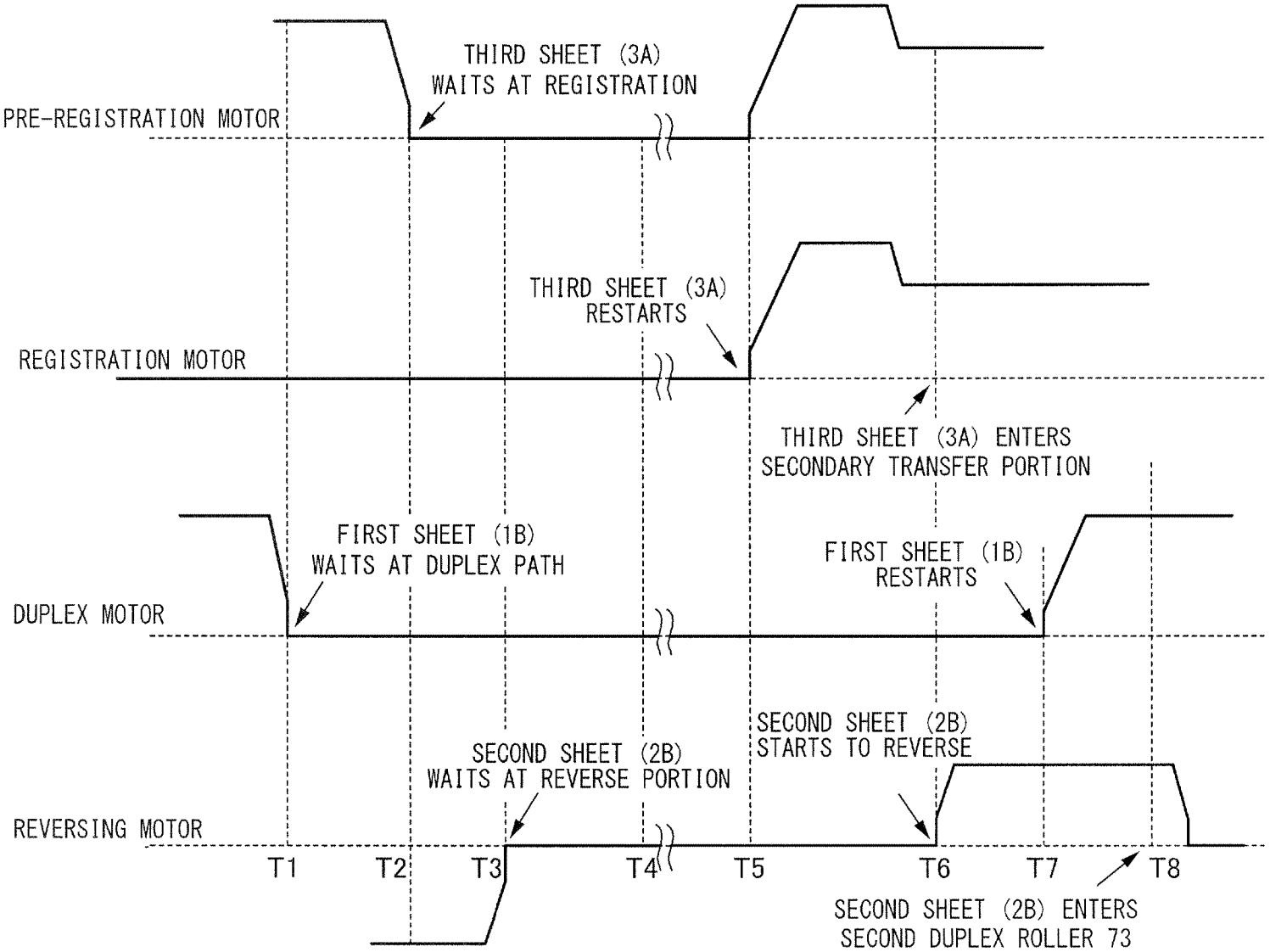
FIG. 11 is a timing chart indicating driving states of the respective motors in the case of executing the waiting process of the first surface in the image forming apparatus of the first embodiment.

After the duplex motor 180 starts to drive, the second sheet (2B) enters the second duplex roller pair 73 and is continuously conveyed by the second duplex roller pair 73. In other words, the drive start timing T6 of the reverse motor 170 is delayed as compared to the drive start timing T5 of the registration motor 130 such that the second sheet (2B) is passed to the second duplex roller pair 73 in the condition in which the duplex motor 180 rotates. Because on and after the state as illustrated in FIG. 10D is the same with the "Case 1" in which no waiting process is carried out, its description will be omitted here. Note that similarly to the "Case 1" in which no waiting process is carried out, the reverse motor 170 may be decelerated such that the conveyance speed of the first duplex roller pair 72 when the second sheet (2B) enters the second duplex roller pair 73 becomes late as compared to the conveyance speed of the second duplex roller pair 73.

Case 3: Waiting Process of Second Surface Is Carried Out

Next, an operation in a case where a waiting process of a second surface is carried out will be described. FIGS. 12A through 12D illustrate operations in a case where the result of the Step S116 in FIG. 7 is Yes, i.e., in a case of waiting a permission of image writing operation for the second surface of the first sheet (1B) in a state in which the leading edge of the second sheet (2B) abuts with the second duplex roller pair 73.

Figure 12A:
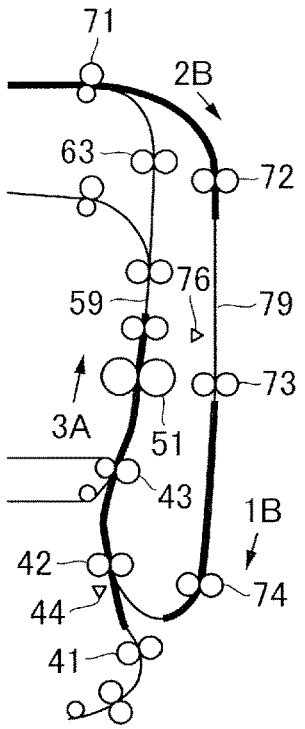
FIG. 12A is a schematic diagram illustrating a step of a duplex printing operation in a case of executing the waiting process of a second surface in the image forming apparatus of the first embodiment.

FIG. 12A illustrates the same state with the state in FIG. 8A, and the first sheet (1B) is conveyed by the third duplex roller pair 74 to the registration roller pair 42 with a predetermined speed, e.g., 300 mm/s. Still further, because the reverse motor 170 is reversely driven, the second sheet (2B) is conveyed by the first duplex roller pair 72 with the predetermined speed, e.g., 300 mm/s.

Figure 12B:
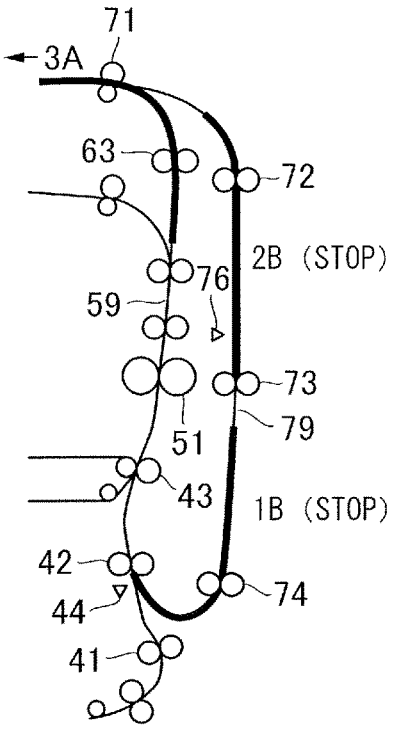
FIG. 12B is a schematic diagram illustrating a step following the step in FIG. 12A.
Figure 12C:
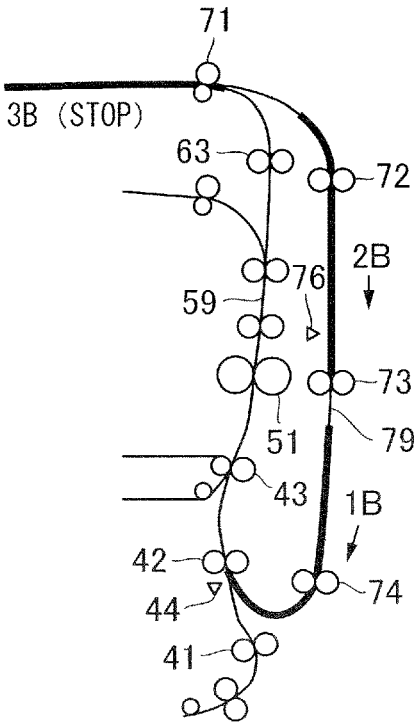
FIG. 12C is a schematic diagram illustrating a step following the step in FIG. 12B.
Figure 12D:
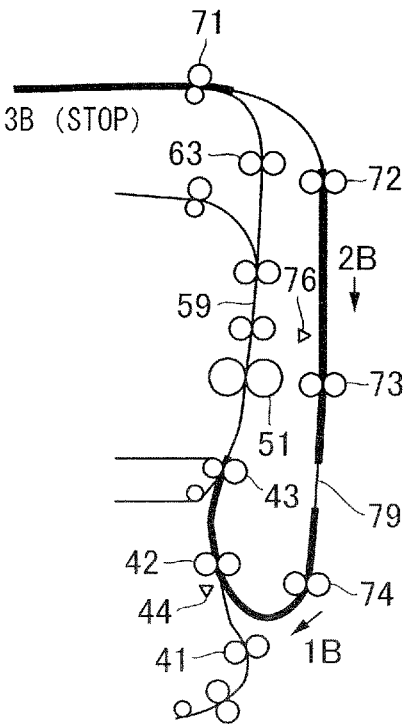
FIG. 12D is a schematic diagram illustrating a step following the step in FIG. 12C.
Figure 13:
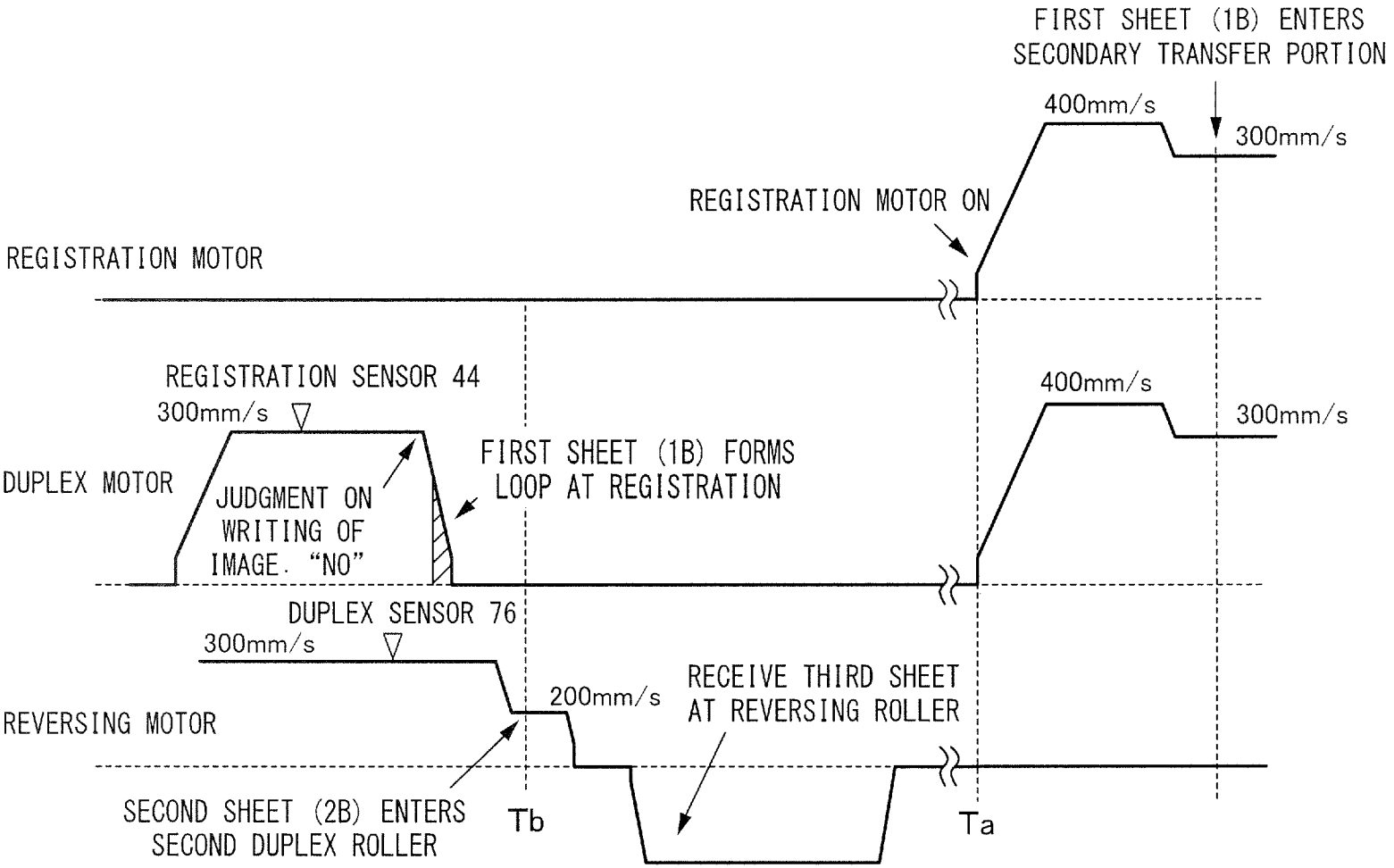
FIG. 13 is a timing chart indicating driving states of the respective motors in the case of executing the waiting process of the second surface in the image forming apparatus of the first embodiment.

Here, as illustrated in FIG. 13, it is assumed that a result of decision on the image writing operation for the first sheet (1B) is "not permitted" at the timing (time Tb in FIG. 13) when the second sheet (2B) arrives at the second duplex roller pair 73. That is, differing from the "Case 1" in which no waiting process is carried out, the timing when the permission of the image writing operation for the first sheet (1B) is issued is later than the timing when the second sheet (2B) arrives at the second duplex roller pair 73 (Tb<Ta). In this case, the duplex motor 180 stops to drive in a state in which the first sheet (1B) is nipped by the third duplex roller pair 74 and the leading edge of the first sheet (1B) abuts with the registration roller pair 42 and forms a loop (see FIG. 12B).

After detecting the leading edge of the second sheet (2B) by the duplex sensor 76, the reverse motor 170 is decelerated such that a conveyance speed of the first duplex roller pair 72 when the second sheet (2B) enters the second duplex roller pair 73 becomes V2=200 mm/s. Because the second duplex roller pair 73 is stopped to drive by the duplex motor 180, the leading edge of the second sheet (2B) abuts with the second duplex roller pair 73. The reverse motor 170 is stopped in a condition in which the second sheet (2B) abuts with the second duplex roller pair 73 and forms a loop (see FIG. 12B).

Here, because the one-way clutch 75 is disposed between the reverse motor 170 and the first duplex roller pair 72, it is possible to start to convey the third sheet (3A) further in the condition in which the second sheet (2B) waits (see FIG. 12B). That is, after the second sheet (2B) abuts with the second duplex roller pair 73, the second duplex roller pair 73 can pull out the second sheet (2B) even if the reverse motor 170 is stopped or is switched to rotate normally. This arrangement makes it possible for the reverse roller pair 71 to receive the third sheet (3A) by normally rotating the reverse motor 170 after the second sheet (2B) has been conveyed to the waiting position (see FIG. 13). Note that the definition of plus and minus of the conveyance speed of the reverse motor of FIG. 13 is the same with that of FIG. 11. The reverse motor 170 stops the reverse roller pair 71 in a state in which the third sheet (3A) is conveyed to the waiting position, i.e., the position where the sheet is reversed (see FIG. 12C).

In a case where it takes a long time for waiting for the permission of the image writing operation for the first sheet (1B) as described above, the three sheets (1B, 2B and 3B) wait in maximum in the reverse conveyance portion 70. That is, in the configuration in which there are less, e.g., two, driving sources, as compared to the maximum number, e.g., three, of waiting sheets, the maximum number of waiting sheets wait at the respective appropriate waiting positions. Then, the conveyance of the second sheet (2B) is started again together with the first sheet (1B) (see FIGS. 12C and 12D) as the duplex motor 180 starts to drive at the timing (Ta) where the go/no-go decision on the image writing operation for the first sheet (1B) is "permitted" (enabled).

Thus, according to the present embodiment, in the case where the first sheet (1B) waits, the second sheet (2B) is made to wait in a state in which the second sheet (2B) has been conveyed to a position where the conveyance of the second sheet (2B) is automatically started again when the duplex motor 180 restarts. In other words, a first operation, i.e., Step S118, of conveying the second sheet (2B) to the position abutting with the second duplex roller pair 73 is executed in a state in which the first sheet (1B) is nipped by the third duplex roller pair 74 and the second driving source (180) stops to drive. Therefore, it becomes possible to restart the conveyance of the first and second sheets which are put in the waiting state by executing a second operation, i.e., Step S119, of causing the second driving source to start to drive the third and fourth conveyance members after the first operation.

Meanwhile, because it is configured such that the transmission of the driving force of the first driving source (170) to the second sheet through the second conveyance member (72) is restricted by the restriction portion (75), it is possible to independently control the conveyance of the third sheet in the state in which the first and second sheets wait. That is, it is possible to make the first conveyance member to receive the third sheet (3A) by driving the first conveyance member (71) in the state in which the transmission of the force of the first driving source to the second sheet is restricted. This arrangement makes it possible to realize the configuration of making three sheets to wait and of restarting their conveyance as necessary by using the two motors. That is, the configuration of the present embodiment enables to reduce the number of motors without reducing the number of sheets to be circulated in the duplex printing operation and to cut down the product cost.

Note that while the case where all three sheets are made to wait have been described in FIGS. 11 and 12, the third sheet (3A) may not be reversed and made wait in a case where the image writing operation for the first sheet (1B) has been permitted before the third sheet (3A) arrives at the reverse and waiting position. That is, in this case, an arrangement is made such that the third sheet (3A) is reversed and conveyed by the reverse roller pair 71 to be sent to the duplex path 79 without stopping to drive the reverse motor 170. In other words, according to the configuration of the present embodiment, it is possible to cause the first driving source to drive the first conveyance member to start to drive the third sheet during execution of the second operation, i.e., in a state in which the second sheet is being pulled out of the second conveyance member.

Figure 14A:
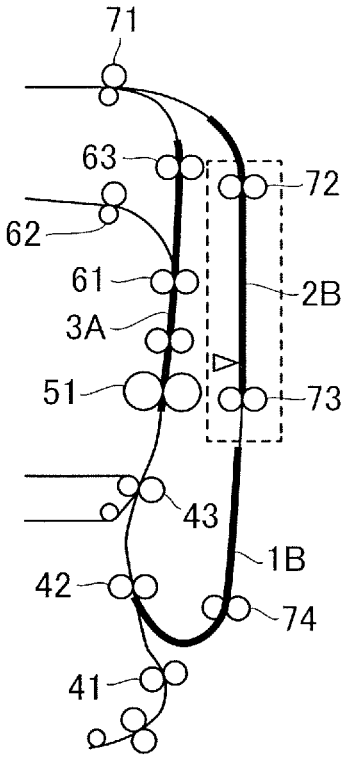
FIG. 14A is a schematic diagram illustrating a state in which a second sheet abuts with a second duplex roller pair in the image forming apparatus of the first embodiment.

Here, the state in which the second sheet (2B) abuts with the second duplex roller pair 73 will be described with reference to FIGS. 14A and 14B. FIG. 14A is a schematic diagram illustrating the state in which the succeeding sheet (2B) abuts with the second duplex roller pair 73 by the waiting process and the reverse motor 170 stops to drive, and FIG. 14B is an enlarged view of a region indicated by a broken line in FIG. 14A.

Figure 14B:
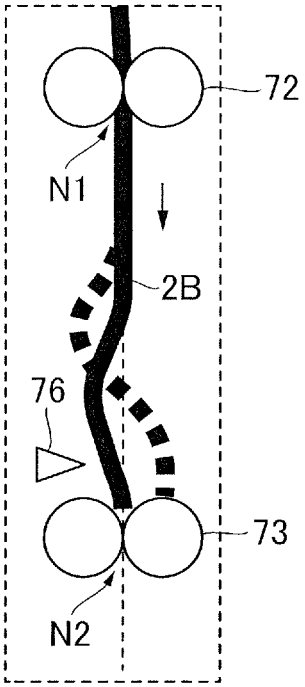
FIG. 14B is an enlarged view of a part in FIG. 14A.

As illustrated in FIG. 14B, the reverse motor 170 drives the first duplex roller pair 72 such that the second sheet (2B) is conveyed to a position where the leading edge of the second sheet (2B) abuts with the nip portion N2 and deflects, i.e., forms a loop. That is, the drive of the reverse motor 170 is controlled such that the second sheet (2B) is fed by a predetermined amount also after the leading edge of the second sheet (2B) has arrived at the second duplex roller pair 73 after the duplex sensor 76 has detected the second sheet (2B). Because the sheet P is nipped by a nip portion N1 of the first duplex roller pair 72, a force of pushing the leading edge of the second sheet (2B) into the nip portion N2 of the second duplex roller pair 73 is generated in the state in which the loop is formed. Due to that, when the second duplex roller pair 73 is started to drive by the duplex motor 180, the second sheet (2B) is securely nipped by the second duplex roller pair 73 and the conveyance is restarted together with the first sheet (1B).

Here, in a case where there exists an extremely large curl or fold that is normally unexpected as indicated by a broken line in FIG. 14B, a case where the second sheet (2B) does not fully enter the nip portion N2 of the first duplex roller pair 72 is also conceivable. In this case, there is also a possibility that the conveyance of the second sheet (2B) is not started even if the duplex motor 180 starts to drive. Therefore, in the case where the second sheet (2B) is made to wait in the re-conveyance path, it is desirable to stop the conveyance of the second sheet (2B) at a position not in contact with the second duplex roller pair 73 if it is not necessary. The present embodiment can minimize a possibility of conveyance failure even in such unexpected case because the second sheet (2B) is made to wait at the reverse roller pair 71 in the "Case 2" in which the waiting process of the first surface is carried out as described above.

Case 4: Operation during Continuous Printing

Behaviors of sheets in a case where a waiting process is carried out in continuously performing the duplex printing on a large number of sheets will be described. As illustrated in FIG. 4C, in the configuration of the present embodiment, four pages of images are formed during when an image is formed on a first surface (N:A) of Nth sheet until an image is formed on a second surface (N:B) in performing continuous duplex printing on a small size sheet.

During that, the behavior of the Nth sheet of the case (ii) or (iii) is the same with the second sheet (2B) described in the "Case 2" where the waiting process of the first surface is carried out or the "Case 3" where the waiting process of the second surface is carried out. That is, in a case (ii) where a waiting process is executed on the first surface (N+1: A) of an (N+1)th sheet, the Nth sheet waits in a condition of being nipped by the reverse roller pair 71. In a case (iii) where a waiting process is executed on the second surface (N−1: A) of an (N−1)th sheet, the Nth sheet waits in a condition of abutting with the second duplex roller pair 73.

The behavior of the Nth sheet in a case (i) where the waiting process of the second surface (N−2:B) of the (N−2) th sheet is the same with the third sheet in the "Case 3" where the waiting process of the second surface is carried out. That is, the Nth sheet waits at the position of the third sheet 3B in FIG. 12C in a state having being conveyed by a predetermined distance by the reverse roller pair 71 in the normal direction after the preceding (N−1)th sheet has abutted against the second duplex roller pair 73 at the position of the second sheet 2B in FIG. 12B.

Still further, the behavior of the Nth sheet in the case (iv) where a waiting process of the first surface (N+2:A) of the (N+2)th sheet is carried out is the same with the first sheet in the "Case 2" where the waiting process of the first surface is carried out. That is, the Nth sheet waits at the position of the first sheet 1B in FIG. 10A in a condition of being nipped by the third duplex roller pair 74. After that, when the registration roller pair 42 starts to convey the (N+2)th sheet, the Nth sheet is sent to the registration roller pair 42 so as to keep a predetermined distance from a trailing edge of the (N+2)th sheet (see FIG. 10D).

This arrangement makes it possible to appropriately manage the positions of the respective sheets in performing the continuous duplex printing on the large number of sheets.

Advantages of the Present Embodiment

Thus, in the configuration in which the preceding sheet can be made to wait while abutting with the second duplex roller pair 73 as necessary, the preceding sheet is made to wait without being reversed intentionally in the case where the waiting process of the first surface of the succeeding sheet is made. That is, after forming an image on the first surface of the second sheet, the conveyance of the second sheet (2B) is stopped in a condition in which the reverse roller pair 71 does not reverse the second sheet (2B) toward the duplex path 79 when the conveyance of the third sheet (3A) is stopped by the registration roller pair 42. After that, the reverse roller pair 71 conveys the second sheet (2B) to the duplex path 79 based on that a permission of image writing operation for the third sheet (3A) has been issued and on that the preparation of an image to be formed on the first surface of the third sheet (3A) is started by the image forming units PY through PK. In other words, when the conveyance of the succeeding sheet is stopped without forming an image on the first surface of the succeeding sheet after forming the image on the first surface of the preceding sheet, the first conveyance member stops the preceding sheet without reversing the preceding sheet in the direction of heading to the second conveyance path. After that, based on the timing when the image forming units start the image forming operation in Step S112 of forming the image on the first surface of the succeeding sheet, an operation of causing the first conveyance member to convey the preceding sheet to the second conveyance path is executed.

This arrangement makes it possible to appropriately manage the sheet positions in forming the images on both surfaces of the sheets while minimizing a possibility of a conveyance failure.

Note that the image formation start timing of the present embodiment refers to timing when the exposing unit initially starts the image writing operation of writing an elastic latent image on the surface of the photosensitive drum in either one image forming unit PY through PK (normally the yellow image forming unit PY). Still further, while the conveyance of the succeeding sheet (3A) is started at the time T5 right after the permission of the image writing operation for the succeeding sheet (3A) is issued and then the conveyance of the preceding sheet (2B) is started again in the example illustrated in FIG. 11, the present disclosure is not limited to such a case. The preceding sheet (2B) may be started to be conveyed toward the second conveyance path before the succeeding sheet is started to be conveyed as long as it is later than the image formation start timing on the succeeding sheet (3A).

Note that it is also advantageous to start to reverse the preceding sheet based on the image formation start timing of the succeeding sheet, as follows. In general, conveyance timing shifts by various factors in conveying sheets. Such factors include tolerance of an outer diameter of the conveyance roller, reduction of the outer diameter caused by wear, delay or early arrival caused by a slip of the conveyance roller for example. It is possible to absorb these conveyance shifts by starting to drive the roller pair at predetermined timing after abutting the sheet against the registration roller pair 42 or the second duplex roller pair 73 for example. In a case where a conveyance path is long in particular, it is possible to reduce a possibility of colliding with a front or rear sheet by providing many spots of absorbing the conveyance shift. Meanwhile, the configuration is complicated if the large number of spots for absorbing the conveyance shift is provided. In the present embodiment, the reverse portion is equal to what absorbs the conveyance shift and contributes for achieving both easiness of the configuration and stability of the conveyance.

Accordingly, the arrangement of starting to reverse the preceding sheet based on the image formation start timing of the succeeding sheet is applicable not only in the configuration of the reverse conveyance portion 70 of the present embodiment. For instance, it is applicable to a configuration in which waiting positions of three sheets are controlled by three driving sources by disposing a motor driving the first duplex roller pair 72 beside the reverse motor 170 and the duplex motor 180. In this case, no operation of abutting the second sheet (2B) against and wait at the second duplex roller pair 73 described in the "Case 3" where the waiting process of the second surface is carried out, and the second sheet (2B) waits upstream of the second duplex roller pair 73. It is possible to achieve both the easiness of the configuration and the stability of the conveyance also in this configuration by using this technology. This technology is also applicable to a configuration in which four or more sheets are made to wait in the reverse conveyance portion 70 or to a configuration in which two sheets are made to wait in the reverse conveyance portion 70.

Second Embodiment

While the first embodiment has been configured to start to reverse the preceding sheet based on the image formation starting timing of the succeeding sheet, the present disclosure is not limited to such configuration. In view of a point of avoiding the abutment with the second duplex roller pair 73 as much as possible, the conveyance of the preceding sheet may be stopped in a state in which the preceding sheet has not arrived at the second duplex roller pair 73. A second embodiment will be described below with reference to FIG. 15. However, components having the same configurations and effects with those of the first embodiment will be denoted by common reference numerals with the first embodiment and their description will be omitted here.

Figure 15:
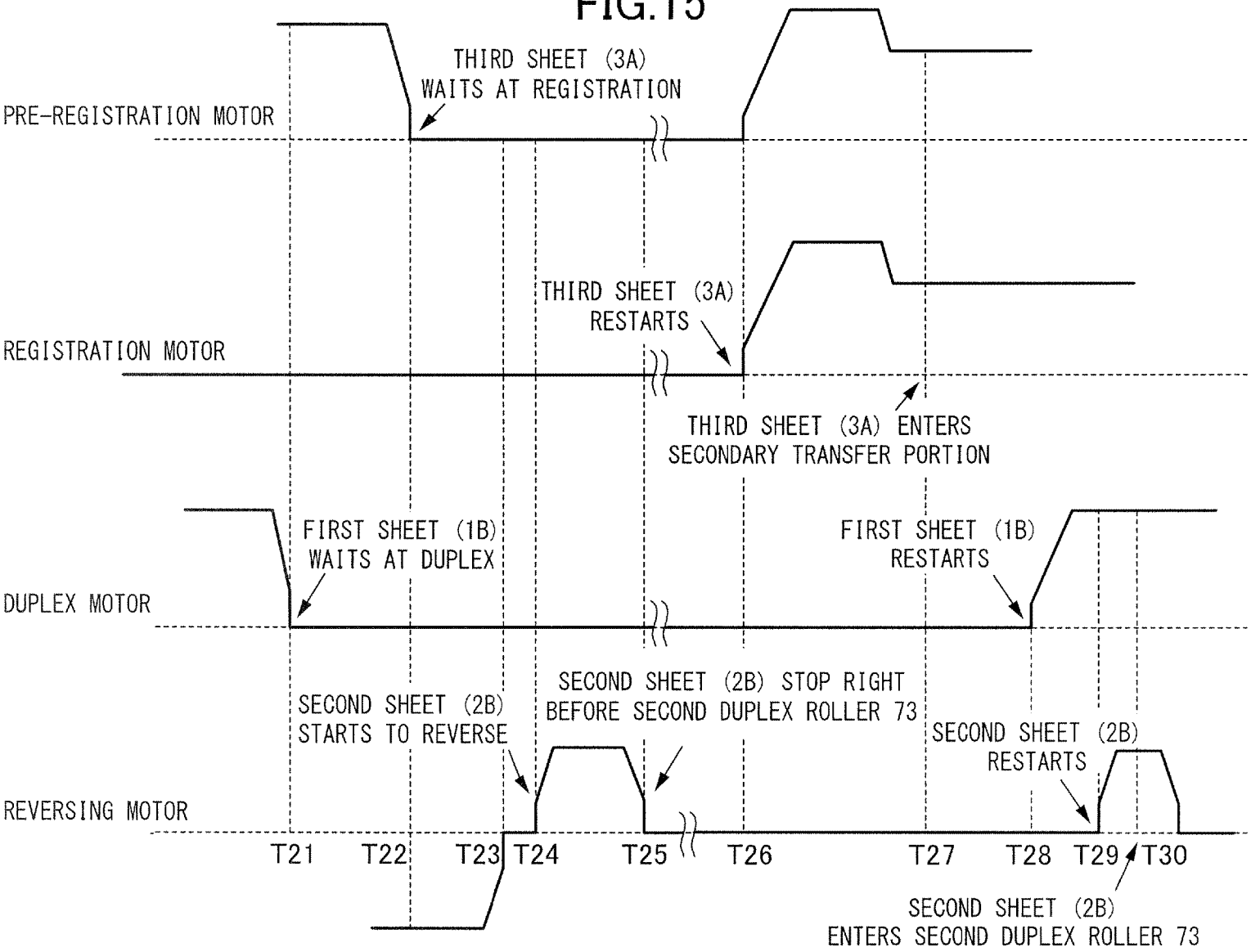
FIG. 15 is a timing chart indicating driving states of the respective motors in a case of executing the waiting process of the first surface in an image forming apparatus of a second embodiment.

FIG. 15 indicates a timing chart of the respective motors corresponding to FIG. 11 in the abovementioned embodiment. An operation until the reverse roller pair 71 coveys the second sheet (2B) by a predetermined distance is the same with the "Case 2" where the waiting process of the first surface is carried out of the first embodiment, and T1 corresponds to T21, T2 with T22 and T3 with T23, respectively.

In the present embodiment, the reverse roller pair 71 conveys the second sheet (2B) in the normal direction by the predetermined distance, stops by a predetermined time (100 ms of settling time, a period between time T23 and T24) and then starts to convey in the reverse direction at time T24. The conveyance in the reverse direction is started regardless whether the permission of the image writing operation for the third sheet (3A) has been issued or not.

In a case where a state in which the permission of the image writing operation for the third sheet (3A) is not issued continues, the reverse motor 170 stops to drive in the state in which the second sheet (2B) is conveyed right before the second duplex roller pair 73 at time T25. The timing of stopping the reverse motor 170 is set such that the second sheet (2B) stops at the position not in contact with the second duplex roller pair 73 by making reference to a detection result of the duplex sensor 76 for example.

After that, when the permission of the image writing operation for the first surface of the third sheet (3A) is issued, the conveyance of the third sheet (3A) is started at time T26. Then, the conveyance of the first sheet (1B) and the second sheet (2B) is started again based on an elapsed time from the start of the conveyance of the third sheet (3A). However, because a waiting position of the second sheet (2B) is set downstream of the reverse conveyance portion 70 as compared to the first embodiment, the restart of the conveyance of the second sheet (2B) is set late more as compared to that of the first embodiment. That is, the reverse motor 170 starts to rotate at time T29 in the reverse direction after the conveyance of the first sheet (1B) is started at time T28 by keeping a predetermined distance from a trailing edge of the third sheet (3A). This arrangement makes it possible to reduce a situation such as a conveyance failure because the second sheet (2B) is passed from the first duplex roller pair 72 to the second duplex roller pair 73 in a condition in which the second duplex roller pair 73 rotates.

As described above, in a case where the waiting process of the first surface of the third sheet is to be made, the conveyance of the second sheet stops in a state in which the second sheet has not arrived at the second duplex roller pair 73, i.e., the third conveyance member, after reversing the second sheet. Then, the second sheet is started to be conveyed again based on the image formation starting timing on the first surface of the third sheet and is passed to the third conveyance member. This arrangement makes it possible to appropriately manage the sheet positions so as to suppress such possibilities as the conveyance failure similarly to the first embodiment.

Modified Embodiments

While the one-way clutch 75 is used as the restriction portion capable of restricting the driving force of the first driving source from being transmitted through the second conveyance member in the first and second embodiments, it may be replaced with another clutch mechanism capable of shutting off the transmission of the drive such as a dog clutch. Still further, a mechanism, e.g., a cam mechanism connected at least one roller shaft of a roller pair and fluctuating a distance between shafts of the roller pair for example, of switching the second duplex roller pair 73 between an abutment condition in which a sheet is nipped and a separate condition in which the nip of the sheet is released may be used as the restriction portion.

Still further, while the conveyance is stopped in a state in which the leading edge of the second sheet (2B) abuts with the second duplex roller pair 73 and forms a loop in the abovementioned embodiment, the conveyance may be stopped at timing when the leading edge of the sheet at a nip position of the second duplex roller pair 73 as long as an accuracy of the conveyance distance is assured. However, in order to deal with variation of the sheet positions caused by fluctuation of the conveyance speed, it is possible to assure the stability of sheet conveyance by forming a loop like the abovementioned embodiment. 5 mm of a feed amount for forming the loop for example was preferable. It was also configured such that stress of the sheet is reduced by curving a conveyance guide composing a part of forming the loop of the duplex path 79 to assure a loop space permitting the loop of the sheet. Note that instead of causing the second sheet (2B) to form the loop, it is also possible to arrange such that a clutch mechanism is disposed in the drive transmission path from the duplex motor 180 to the second duplex roller pair 73 for example to enable the leading edge of the succeeding sheet to enter the nip portion of the second duplex roller pair 73 during the wait time.

Still further, while the reverse motor 170 and the duplex motor 180 are configured to drive the two sets of roller pairs, respectively, in the abovementioned embodiment, it is also possible to configure such that one or both of the motors drive three or more sets of roller pairs. For instance, a roller pair may be added between the second duplex roller pair 73 and the third duplex roller pair 74 or between the reverse roller pair 71 and the first duplex roller pair 72. However, it is necessary to provide the restriction portion such as the one-way clutch in a case where a roller pair is added at the position where the sheet is held in the waiting state and where the sheet is pulled out by the second duplex roller pair 73.

The speed control and the specific driving speeds of the respective motors described in FIGS. 9, 11, 13 and 15 can be appropriately modified. For instance, in a case where a sheet needs not wait at the registration roller pair 42, the drive of the registration motor 130 is started without stopping the drive of the duplex motor 180 in the abovementioned embodiment (see FIG. 8). However, drive of the duplex motor 180 may be temporarily stopped after forming the loop instead of a so-called nonstop registration as described above.

Still further, while the motor is adopted as the driving source in the abovementioned embodiments, actuators other than the motors may be adopted as the first through third driving sources. For instance, an arrangement is made such one common motor is provided and a route of transmitting the driving force to the reverse roller pair 71 and the first duplex roller pair 72 and a route transmitting the driving force to the second duplex roller pair 73 and the third duplex roller pair 74 are provided. In this case, each of the drive transmission members in which a drive condition can be independently controlled by an electromagnetic clutch corresponds to the driving source.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2018-122284, filed on Jun. 27, 2018, and 2019-086469, filed on Apr. 26, 2019, which are hereby incorporated by reference herein in their entirety.

What is claimed is:

1. An image forming apparatus comprising:

a first conveyance path;

an image former configured to form an image on a sheet passing through the first conveyance path;

a first conveyance roller configured to convey the sheet received from the first conveyance path in a first direction and reverse the sheet in a second direction opposite from the first direction;

a second conveyance path through which the sheet reversed by the first conveyance roller is guided to the first conveyance path;

a first driving motor configured to drive the first conveyance roller; and a controller configured to control the first driving motor such that in a case where images are to be formed on a first surface of a preceding sheet, on a first surface of a succeeding sheet fed to the first conveyance path succeeding to the preceding sheet, and on a second surface of the preceding sheet, the controller causes the first conveyance roller to stop before the first conveyance roller starts to reverse the preceding sheet in the second direction in a case where an image has been formed on the first surface of the preceding sheet and permission for preparing the image to be formed on the first surface of the succeeding sheet is not issued yet, and the controller causes the first conveyance roller to start to reverse the preceding sheet to the second conveyance path based on timing when the image former starts preparing the image to be formed on the first surface of the succeeding sheet.

2. The image forming apparatus according to claim 1, wherein the first conveyance roller is configured to convey the sheet received from the first conveyance path in the first direction by a predetermined distance and then reverse the sheet to the second conveyance path in the second direction, and wherein if permission for preparing the image to be formed on the first surface of the succeeding sheet is not issued after the image has been formed on the first surface of the preceding sheet by a time the first conveyance roller finishes conveying the preceding sheet in the first direction by the predetermined distance, the controller causes the first conveyance roller to hold the preceding sheet at a position where the preceding sheet has been conveyed in the first direction by the predetermined distance and not to reverse the preceding sheet in the second direction until the controller causes the first conveyance roller to restart conveyance of the preceding sheet.

3. The image forming apparatus according to claim 1, further comprising:

a registration roller disposed on the first conveyance path and configured to convey a sheet to the image former;

a second conveyance roller disposed on the second conveyance path and configured to be driven by the first driving motor to convey the sheet reversed by the first conveyance roller;

a third conveyance roller disposed on the second conveyance path and configured to convey the sheet delivered from the second conveyance roller toward the registration roller;

a second driving motor configured to drive the third conveyance roller; and a restrictor capable of restricting transmission of drive from the first driving motor to the second conveyance roller, wherein the controller is configured to execute either a first mode or a second mode in a case where the first conveyance roller has started to reverse the preceding sheet after the first conveyance roller is stopped before the first conveyance roller starts to reverse the preceding sheet, wherein in the first mode, the controller causes the preceding sheet to wait in contact with the third conveyance roller in a stopped state, and then causes the third conveyance roller to convey the preceding sheet in a condition where transmission of drive to the second conveyance roller is restricted by the restrictor, and wherein in the second mode, the controller causes the preceding sheet to be passed from the second conveyance roller to the third conveyance roller in a driven state, without causing the preceding sheet to wait in contact with the third conveyance roller in the stopped state.

4. The image forming apparatus according to claim 3, wherein the restrictor is a one-way clutch.

5. The image forming apparatus according to claim 3, wherein in a case where images are to be formed on a first surface of a first sheet, on a first surface of a second sheet fed to the first conveyance path succeeding to the first sheet, on a first surface of a third sheet fed to the first conveyance path succeeding to the second sheet, on a second surface of the first sheet, and on a second surface of the second sheet, the controller causes the first conveyance roller to stop before the first conveyance roller starts to reverse the second sheet in a case where the image has been formed on the first surface of the second sheet and permission for preparing an image to be formed on the first surface of the third sheet is not issued yet, and the controller causes the second conveyance roller to stop after conveying the second sheet to abut with the third conveyance roller in a case where the image has been formed on the first surface of the third sheet and permission for preparing an image to be formed on the second surface of the first sheet is not issued yet.

6. The image forming apparatus according to claim 3, wherein in a case where the first conveyance roller starts to reverse the preceding sheet after the first conveyance roller is stopped before the first conveyance roller starts to reverse the preceding sheet, the controller delays start of reversing of the preceding sheet by the first conveyance roller as compared to start of conveyance of the succeeding sheet by the registration roller, such that the preceding sheet is passed from the second conveyance roller to the third conveyance roller in a state where the second driving roller has started to rotate the third conveyance roller for forming an image on another sheet conveyed through the second conveyance path preceding to the preceding sheet.

7. The image forming apparatus according to claim 3, wherein the controller executes the first mode on the preceding sheet in a case where permission for preparing an image to be formed on another sheet conveyed to the second conveyance path preceding to the preceding sheet is not issued since reversing of the preceding sheet has started until the preceding sheet reaches the third conveyance roller, and wherein the controller executes the second mode on the preceding sheet in a case where permission for preparing the image to be formed on the another sheet is issued after reversing of the preceding sheet is started and before the preceding sheet reaches the third conveyance roller.

8. The image forming apparatus according to claim 1, wherein the permission for preparing an image is issued after an image loading time has elapsed, the image loading time being a time required for the controller to process image data transferred from an external computer into a data format supported by the image former.

9. An image forming apparatus comprising:

a first conveyance path;

an image former configured to form an image on a sheet passing through the first conveyance path;

a first conveyance roller configured to receive the sheet from the first conveyance path and convey the sheet to reverse the sheet;

a second conveyance path through which the sheet reversed by the first conveyance roller is guided to the first conveyance path;

a second conveyance roller disposed on the second conveyance path and configured to convey the sheet reversed by the first conveyance roller;

a third conveyance roller disposed on the second conveyance path and configured to convey the sheet reversed by the first conveyance roller toward the first conveyance path;

a first driving motor configured to drive the first conveyance roller and the second conveyance roller;

a second driving motor configured to drive the third conveyance roller;

a registration roller disposed on the first conveyance path and configured to convey a sheet to the image former;

a restrictor capable of restricting transmission of drive from the first driving motor to the second conveyance roller; and a controller configured to control the first driving motor and the second driving motor such that in a case where images are to be formed on a first surface of a preceding sheet, on a first surface of a succeeding sheet fed to the first conveyance path succeeding to the preceding sheet, and on a second surface of the preceding sheet, the controller stops the first driving motor to stop conveyance of the preceding sheet in a state before a leading edge, in a sheet conveyance direction of the second conveyance path, of the preceding sheet reaches the third conveyance roller in a case where an image has been formed on the first surface of the preceding sheet and permission for preparing the image to be formed on the first surface of the succeeding sheet is not issued yet, and the controller restarts drive of the first driving motor to pass the preceding sheet to the third conveyance roller based on timing when the image former starts preparing the image to be formed on the first surface of the succeeding sheet, wherein the controller is configured to execute either a first mode or a second mode in a case where the first conveyance roller has restarted conveyance of the preceding sheet after conveyance of the preceding sheet is stopped in a state before the preceding sheet reaches the third conveyance roller, wherein in the first mode, the controller causes the preceding sheet to wait in contact with the third conveyance roller in a stopped state, and then causes the third conveyance roller to convey the preceding sheet in a condition where transmission of drive to the second conveyance roller is restricted by the restrictor, and wherein in the second mode, the controller causes the preceding sheet to be passed from the second conveyance roller to the third conveyance roller in a driven state, without causing the preceding sheet to wait in contact with the third conveyance roller in the stopped state.

10. The image forming apparatus according to claim 9, wherein the restrictor is a one-way clutch.

11. The image forming apparatus according to claim 9, wherein in a case where images are to be formed on a first surface of a first sheet, on a first surface of a second sheet fed to the first conveyance path succeeding to the first sheet, on a first surface of a third sheet fed to the first conveyance path succeeding to the second sheet, on a second surface of the first sheet, and on a second surface of the second sheet, the controller stops the first driving motor to stop conveyance of the second sheet in a state before the second sheet reaches the third conveyance roller in a case where the image has been formed on the first surface of the second sheet and permission for preparing an image to be formed on the first surface of the third sheet is not issued yet, and the controller stops the first driving motor after the second sheet is conveyed to abut with the third conveyance roller in a case where the image has been formed on the first surface of the second sheet and permission for preparing the image to be formed on the second surface of the first sheet is not issued yet.

12. The image forming apparatus according to claim 9, wherein in a case where the first conveyance roller restarts conveyance of the preceding sheet after stopping conveyance of the preceding sheet in a state before the preceding sheet reaches the third conveyance roller, the controller delays restart of conveyance of the preceding sheet by the first conveyance roller as compared to start of conveyance of the succeeding sheet by the registration roller, such that the preceding sheet is passed from the second conveyance roller to the third conveyance roller in a state where the second driving motor has started to rotate the third conveyance roller for forming an image on another sheet conveyed through the second conveyance path preceding to the preceding sheet.

13. The image forming apparatus according to claim 9, wherein the controller executes the first mode on the preceding sheet in a case where permission for preparing an image to be formed on another sheet conveyed to the second conveyance path preceding to the preceding sheet is not issued since conveyance of the preceding sheet has restarted until the preceding sheet reaches the third conveyance roller, and wherein the controller executes the second mode on the preceding sheet in a case where permission for preparing an image to be formed on the another sheet is issued after conveyance of the preceding sheet has restarted and before the preceding sheet reaches the third conveyance roller.

* * * * *